US011333394B2

(12) United States Patent
Bush

(10) Patent No.: US 11,333,394 B2
(45) Date of Patent: May 17, 2022

(54) SYSTEM AND METHOD FOR DRAINING WATER FROM AN AIR-CONDITIONER

(71) Applicant: Mitsubishi Electric US, Inc., Cypress, CA (US)

(72) Inventor: Joseph Paul Bush, Lawrenceville, GA (US)

(73) Assignee: MITSUBISHI ELECTRIC US, INC., Cypress, CA (US)

( * ) Notice: Subject to any disclaimer, the term of this patent is extended or adjusted under 35 U.S.C. 154(b) by 463 days.

(21) Appl. No.: 16/555,343

(22) Filed: Aug. 29, 2019

(65) Prior Publication Data

US 2021/0063046 A1 Mar. 4, 2021

(51) Int. Cl.
*F24F 13/22* (2006.01)
*B08B 3/02* (2006.01)

(52) U.S. Cl.
CPC ..... *F24F 13/222* (2013.01); *B08B 3/02* (2013.01); *F24F 2013/227* (2013.01)

(58) Field of Classification Search
CPC .... F24F 13/222; F24F 13/22; F24F 2013/227; B08B 3/02
See application file for complete search history.

(56) References Cited

U.S. PATENT DOCUMENTS 2,797,559 A * 7/1957 Atchison ..... F24F 13/22 62/280
4,637,223 A * 1/1987 Hosoya ..... F24F 1/027 62/263
4,977,750 A * 12/1990 Metcalfe ..... F24F 1/027 62/77
5,622,058 A * 4/1997 Ramakrishnan ..... F24F 13/20 62/295
6,247,326 B1 * 6/2001 Likitcheva ..... F24F 13/222 62/279
8,495,822 B2 * 7/2013 Kim ..... F26B 21/086 34/73
2007/0113574 A1 * 5/2007 Davenport ..... F24F 13/224 62/285
2017/0219245 A1 * 8/2017 Carter ..... F24F 13/24
2017/0307251 A1 * 10/2017 Baruch ..... F24F 13/30

FOREIGN PATENT DOCUMENTS

| | | | |
|---|---|---|---|
| CN | 106595156 | A | 4/2017 |
| CN | 106931826 | A | 7/2017 |
| CN | 108361883 | A | 8/2018 |
| JP | 2007-046803 | A | 2/2007 |
| KR | 20130008990 | A | 1/2013 |

* cited by examiner

*Primary Examiner* — Emmanuel E Duke
(74) *Attorney, Agent, or Firm* — Posz Law Group, PLC

(57) ABSTRACT

An air-conditioner, comprising: an indoor coil; an outdoor coil; a drain pan under the indoor and outdoor coils, the drain pan including a slinging trough having a slinging depth, a draining trough having a draining depth, a pumping trough having a pumping depth, and a drain hole formed in a bottom surface of the draining trough; a drain valve for selectively allowing liquid to pass through the drain hole; a drain pump for selectively pumping liquid out of the pumping trough; a fan for blowing air on the outdoor coil and moving the liquid from the slinging trough onto the outdoor coil when the fan is operating; and a controller for controlling operation of at least the drain pump and the fan, wherein the pumping depth is greater than the draining depth, the draining depth is greater than the slinging depth.

16 Claims, 9 Drawing Sheets

SYSTEM AND METHOD FOR DRAINING WATER FROM AN AIR-CONDITIONER

FIELD OF THE INVENTION

The subject matter described below relates generally to air-conditioning systems that include cooling coils that generate condensate (water). More particularly, the described subject matter relates to an air-conditioning system that can effectively drain condensate at all temperatures even at extremely low temperatures.

BACKGROUND OF THE INVENTION

Some air-conditioning systems include two heating/cooling coils: an indoor coil that operates to exchange heat with indoor air and an outdoor coil that operates to exchange heat with outdoor air. In a cooling operation the indoor coil will operate at a relatively low temperature (below a set point temperature for the air-conditioning system) and the outdoor coil will operate at a relatively high temperature (above the set point temperature). Similarly, in a heating operation the indoor coil will operate at a relatively high temperature (above the set point temperature) and the outdoor coil will operate at a relatively low temperature (below the set point temperature). When the temperature of one of the coils drops below the dew point, water may condense out of the corresponding air (indoor or outdoor) and form on the corresponding cooling coil. This water will then drip from the coil to the area below the air-conditioner.

A drain pan is typically provided under the indoor and outdoor coils for collecting the condensate (water) that forms on the coils and drips beneath the air-conditioner. Such a drain pan will typically include a drain hole to allow water to flow out of the drain pan in a controlled manner to a place where the water will not damage the air-conditioner. For example, the drain hole could be connected to a drain pipe that carries water away from the air-conditioner, the drain hole could be located at a low point of the air-conditioner where draining water will flow away from the air-conditioner, etc. Often the drain hole opens to a location outside the building where the air-conditioner is located to allow water to drain into an outside area so that the residents of the building do not need to concern themselves with disposing of drained water.

One problem that occurs in such conventional air-conditioners is that when the outdoor temperature drops to near or below freezing (i.e., 0° C. at sea level) the water draining out of the drain hole can freeze, blocking the drain hole and preventing the water in the drain pan from passing from the drain pan to outside of the air-conditioner. In such a situation condensed water from the cooling coil could then accumulate in the drain pan and eventually overflow from the drain pan, spilling water in undesirable places such as on electronic components, inside the building being cooled, etc. Furthermore, even if the water did drain out of the drain hole before it had a chance to freeze, it would freeze wherever it settled, which can be undesirable. For example, the drained water might freeze inside a drainage tube, along the side of the building the air-conditioner was in, on the ground beneath the drain hole, etc.

In many air-conditioning systems that employ heat pumps, the heat pumps do not operate well at temperatures below freezing. However, some heat pumps can operate at temperatures below freezing. Such heat pumps will accumulate precipitation on an evaporating coil, though that precipitation may take the form of frost rather than condensation. Nevertheless, when a defrosting operation is performed to remove the frost from the evaporating coil, it will drip down into the drain pan. However, when the outside temperature is below freezing, it is typically not safe to discharge the water from the drain pan using conventional systems. As a result, conventional air-conditioning systems typically do not allow a heat pump to operate below freezing outdoor temperatures. Such air-conditioning systems employ electric strip heat for heating below freezing temperatures, which is expensive to operate.

It would therefore be desirable to provide a mechanism that will allow water to be removed from a drain pan regardless of the outside temperature. Such a system would be able to remove water from the drain pan whether the temperature was above or below freezing, allowing the successful operation of the drain pan in all circumstances. This would allow a heat pump to operate below freezing, which can dramatically reduce the overall energy usage of an air-conditioning system.

SUMMARY OF THE INVENTION

An air-conditioner is provided, comprising: an indoor coil configured to exchange heat with indoor air at an indoor location; an outdoor coil configured to exchange heat with outdoor air outside of the indoor location; a drain pan located under the indoor coil and the outdoor coil, the drain pan being configured to catch liquid that drips from the indoor coil and the outdoor coil, the drain pan including a slinging trough having a slinging depth below a reference level of the drain pan, a draining trough having a draining depth below the reference level, a pumping trough having a pumping depth below the reference level, and a drain hole formed in a bottom surface of the draining trough at the draining depth; a drain valve configured to selectively allow liquid in the drain trough to pass through the drain hole; a drain pump configured to selectively pump liquid out of the pumping trough through a drain hose; a fan configured to blow air on the outdoor coil, the fan including a fan blade having a slinger ring, the slinger ring being configured to take liquid from the slinging trough and move the liquid from the slinging trough onto the outdoor coil when the fan is operating; and a controller configured to control operation of at least the drain pump and the fan, wherein the reference level is a level of the drain pan on which at least one of the indoor coil and the outdoor coil rests, the pumping depth is greater than the draining depth, the draining depth is greater than the slinging depth, and the slinging trough, the draining trough, and the pumping trough are all connected such that water draining from the indoor coil and the outdoor coil will initially settle into the pumping trough, will settle into the draining trough only when the pumping trough is filled, and will settle into the skimming trough only when the pumping trough and the draining trough are filled.

The drain pump may be further configured to deposit the pumped liquid on the indoor coil.

The drain pan may further comprise an indoor discharge pathway having an indoor discharge depth, the indoor discharge pathway being located at least partially under the indoor coil and being connected to at least one of the slinging tough, the draining trough, and the pumping trough such that the liquid that drops from the indoor coil will drop into the indoor discharge pathway and will pass from the indoor discharge pathway to at least one of the slinging tough, the draining trough, and the pumping trough, and an outdoor discharge pathway having an outdoor discharge depth, the outdoor discharge pathway being located at least partially under the outdoor coil and being connected to at least one of the slinging tough, the draining trough, and the pumping trough such that liquid that drops from the outdoor coil will drop into the outdoor discharge pathway and will pass from the outdoor discharge pathway to at least one of the slinging trough, the draining trough, and the pumping trough, wherein the draining depth is greater than both the indoor discharge depth and the outdoor discharge depth.

The drain valve may further comprise a drain plug capable of selectively moving into either a closed position in which the drain plug obstruct the drain hole and an open position in which the drain plug does not obstruct the drain hole, wherein the drain plug is configured to move between the open and closed positions based on a valve temperature of the drain valve.

The drain pump may be a centrifugal pump.

The air-conditioner may further comprise: a heater attached to the drain pipe, the heater being configured to selectively heat liquid passing through the drain pipe.

The air-conditioner may further comprise: a heater attached to the drain pump, the heater being configured to selectively heat liquid passing through the drain pump.

The air-conditioner may further comprise: a heater attached to the drain pan, the heater being configured to selectively heat liquid settled in the drain pan.

A first difference between the pumping depth and the draining depth may be between ⅛ inch and 1 inch, and a second difference between the draining depth and the slinging depth may be between ⅛ inch and 1 inch.

The air-conditioner may further comprise: a temperature sensor configured to detect at least one of an internal temperature inside the air-conditioner or an outdoor temperature outside the air conditioner.

A method of operating an air-conditioner having an indoor coil, an outdoor coil, a drain pan, and a fan is provided, the method comprising: determining that the air-conditioner is operating in a heating mode; detecting one of an internal temperature inside the air-conditioner and an outdoor temperature outside the air-conditioner as a detected temperature; determining that the detected temperature is below a threshold temperature; and pumping liquid settled in the drain pan out of the drain pan after determining that the detected temperature is below the threshold temperature, wherein the liquid is pumped from a pumping depth in the drain pan below a reference level, the pumping depth is lower than a slinging depth in the drain pan below the reference level, the slinging depth is a depth at which fan blades of the fan will contact liquid gathered in the drain pan, and the reference level is a level of the drain pan on which at least one of the indoor coil and the outdoor coil rests.

The threshold temperature may be between 32° F. and 40° F.

The operation of pumping the liquid out of the drain pan may further include depositing the pumped liquid on the indoor coil.

The pumping depth may be lower than a draining depth in the drain pan below the reference level, and the draining depth may be a depth at which a drain hole is provided in the drain pan to allow liquid to drain from the drain pan.

The draining depth may be below the slinging depth, a first difference between the pumping depth and the draining depth may be between ⅛ inch and 1 inch, and a second difference between the draining depth and the slinging depth may be between ⅛ inch and 1 inch.

The method may further comprise: heating the liquid in one of the drain pan, a drain pump configured to pump the liquid from the drain pan, and a drain pipe connected to the drain pump.

A method of cleaning an operating an air-conditioner having an indoor coil, an outdoor coil, and a drain pan is provided, the method comprising: spraying an undiluted cleaning solution on the indoor coil; activating the air-conditioner in a cooling mode at a start time such that the indoor coil operates to draw heat from incoming air; gathering undiluted cleaning solution dripping from the indoor coil and condensate dripping from the indoor coil in the drain pan to form a diluted solution; turning on a drain pump to repeatedly pump the diluted solution from the drain pan onto the indoor coil from the starting time to a first time after the starting time when a current level of the diluted solution in the drain pan exceeds a first threshold level; continually gathering the diluted solution dripping from the indoor coil and the condensate dripping from the indoor coil in the drain pan from the starting time to the first time to update the diluted solution such that the ratio of cleaning solution to water in the diluted solution continually drops; repeatedly moving the diluted solution from the drain pan onto the indoor coil from the starting time to the first time when the current level of the diluted solution in the drain pan exceeds a second threshold level; turning off the drain pump at the first time; continually gathering the condensate dripping from the indoor coil in the drain pan from the first time to a second time after the first time to update the diluted solution such that the ratio of cleaning solution to water in the diluted solution continually drops; repeatedly moving the diluted solution from the drain pan onto the outdoor coil from the first time to the second time when the current level of the diluted solution in the drain pan exceeds the second threshold level; and turning off the air-conditioner at the second time, wherein the first threshold level is lower than the second threshold level.

The first time may be between 20 minutes and 60 minutes, and the second time may be between 40 minutes and 90 minutes.

A difference between the first threshold level and the second threshold level may be between ⅛ inch and 1 inch.

The operation of turning on the air conditioner may be performed at a third time between the operation of spraying the undiluted cleaning solution on the indoor coil and the first time, and the third time may be between 3 and 12 minutes after the operation of spraying the undiluted cleaning solution on the indoor coil is completed.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Air-Conditioner Having a Multiple-Tiered Drain Pan

Figure 1:
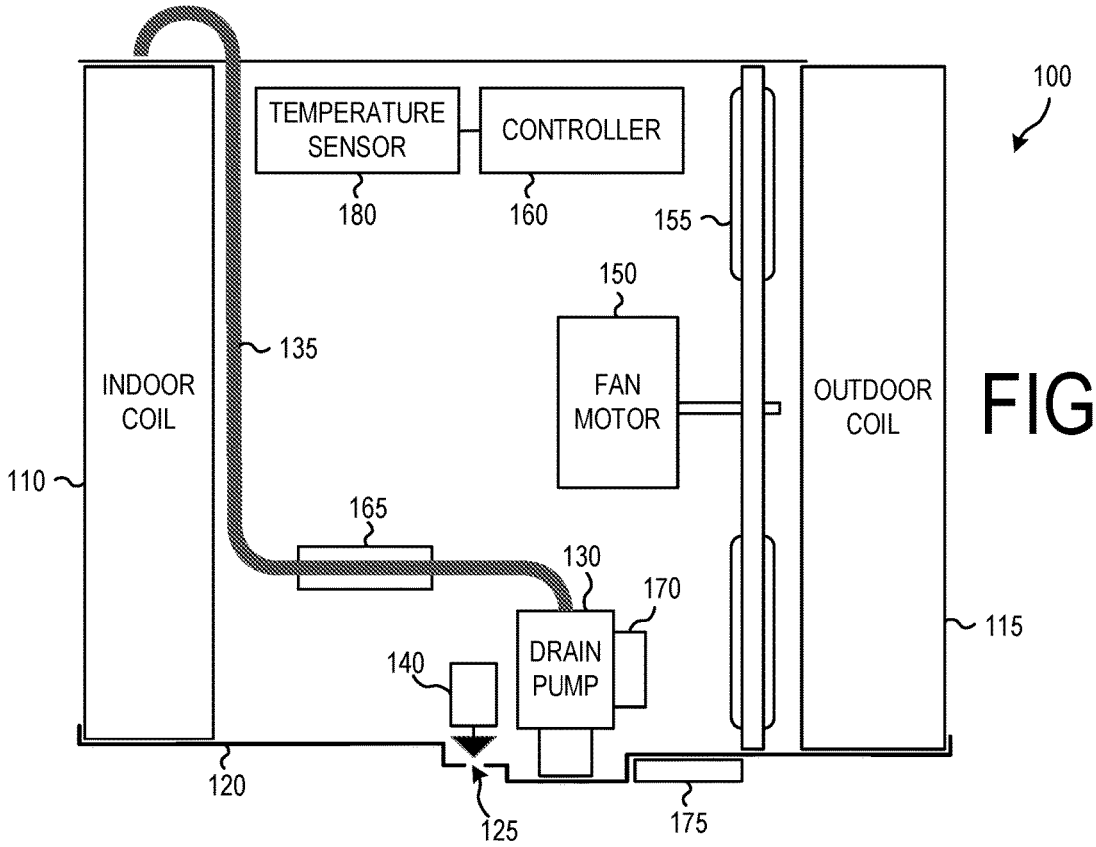
FIG. 1 is a block diagram of an air-conditioner having a multiple-tiered drain pan according to disclosed embodiments.

FIG. 1 is a block diagram of an air-conditioner 100 having a multiple-tiered drain pan 120 according to disclosed embodiments. As shown in FIG. 1, the air-conditioner 100 includes an indoor coil 110, an outdoor coil 115, a drain pan 120, a drain pump 130, a drain hose 135, a drain valve 140, a fan motor 150, a fan blade 155, a controller 160, a pipe heater 165, a pump heater 170, a pan heater 175, and a temperature sensor 180. The drain pan 120 has a drain hole 125 located in a draining trough in the drain pan 120.

The indoor coil 110 is an air-conditioner coil located adjacent to a room or a building whose temperature is to be regulated. In operation the air-conditioner 100 draws in air from the room or building, passes it over the indoor coil 110, which contains refrigerant, exchanges heat between the indoor coil 110 and the indoor air, and returns the conditioned air to the room or building at a more desirable temperature (i.e., cooler if the air-conditioner 100 is in a cooling mode or warmer if the air-conditioner 100 is in a heating mode). In different modes of operation the indoor coil 110 operates as an evaporator coil or a condenser coil.

During a cooling mode in which the indoor air is being cooled, the indoor coil 110 operates as an evaporator coil. In this mode, the indoor coil 110 will be cooler than the indoor air. As a result, when it exchanges heat with the indoor air it will operate to cool the indoor air.

Likewise, during a heating mode in which the indoor air is being heated, the indoor coil 110 operates as a condenser coil. In this mode, the indoor coil 110 will be warmer than the indoor air. As a result, when it exchanges heat with the indoor air it will operate to heat the indoor air.

The outdoor coil 115 is an air-conditioning coil located adjacent to an area outside the room or building whose temperature is to be regulated. Generally, this will be a place that has access to outdoor air (i.e., air at an ambient outside temperature). In operation, the air-conditioner 100 draws in outside air, passes it over the outdoor coil 115, which contains refrigerant, exchanges heat between the outdoor coil 115 and the outdoor air, and returns the air to the outside. In different modes of operation the outdoor coil 115 operates as an evaporator coil or a condenser coil.

During a cooling mode in which the indoor air is being cooled, the outdoor coil 115 operates as a condenser coil. In this mode, the outdoor coil 115 will be warmer than the outdoor air. As a result, when it exchanges heat with the outdoor air it will operate to warm the outdoor. In this way, the air-conditioner 100 can get rid of waste heat that it generates when cooling the indoor air.

Likewise, during a heating mode in which the indoor air is being heated, the outdoor coil 115 operates as an evaporator coil. In this mode, the outdoor coil 115 will be cooler than the outdoor air. As a result, when it exchanges heat with the outdoor air it will operate to draw in heat and cool the outdoor air.

Thus, whether the air-conditioner 100 is in a cooling mode or a heating mode, one of the indoor coil 110 or the outdoor coil 115 will be operating as an evaporator coil.

When a coil 110, 115 is operating as an evaporator coil, condensate (i.e., water) can form on the coil 110, 115 and will drip off of the coil 110, 115. Water condenses from the air that passes over the coil 110, 115 because when the coil 110, 115 is operating as an evaporator coil it is cooler than the air that passes over the coil 110, 115. The amount of condensate that forms on a coil 110, 115 operating as an evaporator coil will vary based on the temperature and humidity of the air passing over the coil 110, 115, but will typically be present in some degree.

The drain pan 120 is a container located under both the indoor coil 110 and the outdoor coil 115 and operates to collect condensate (water) that drips from either of the indoor coil 110 or the outdoor coil 115. The drain pan 120 can have different shapes and configurations, but it should be configured such that it collects water dripping from the indoor and outdoor coils 110, 115, and such that it has a mechanism for removing the collected water in a controlled manner before it overflows the sides of the drain pan 120. If the water overflows the sides of the drain pan 120, it can spill in undesirable locations (e.g., on mechanical or electronic equipment, inside the room or building, etc.).

The drain pan 120 includes a drain hole 125 on a bottom surface. The drain hole 125 allows water in the drain pan 120 to be removed to a controlled location (e.g., an external drain inside the building, or a location outside the building). The drain hole 125 can be open directly to a desired location, or could be connected to an additional hose that routes the draining water to a different location. In the disclosed embodiments, the drain hole 125 is not located at a lowest bottom surface of the drain pan 120. The drain hole 125 is typically of a size that is large enough to allow more water to drain out of the drain pan 120 than will collect based on condensate from one of the coils 110, 115. Thus, when water is draining out of the drain hole 125, the water level in the drain pan 120 will not rise.

The drain pan 120 can be formed out of metal, plastic, or any suitable material. If the drain pan 120 is formed out of metal, it will typically be formed of a non-rusting metal, since it is designed to hold water.

The drain pump 130 is a water pump that operates to selectively pump water out of the drain pan 120 and onto the indoor coil 110 via the drain hose 135. The drain pump 130 can be any suitable kind of water pump, such as a centrifugal pump. Centrifugal pumps are dependable and quiet, and typically consume relatively small amounts of power compared to an air-conditioning system. The drain pump 130 is typically configured such that it will pump water more quickly than it can collect based on condensate from one of the coils 110, 115. Thus, when water is being pumped out of the drain pan 120 via the drain pump 130, the water level in the drain pan 120 will not rise.

The drain hose 135 is connected between the drain pump 130 and the indoor coil 110 and serves as a conduit between the two. The drain hose 135 receives water from the drain pump 130 and empties that water onto the indoor coil 110.

The drain valve 140 operates to selectively switch between an open position and a closed position. When the drain valve 140 is in the open position, the drain hole 125 in the drain pan 120 is not obscured, allowing water in the drain pan 122 flow out of the drain hole 125. When the drain valve 140 is in the closed position, it blocks the drain hole 125, preventing water from flowing out of the drain hole 125.

The drain valve 140 may be a self-contained valve that moves between the open and closed positions using an internal temperature actuated bellows. In such an embodiment, the drain valve 140 would be set in the closed position when an internally detected valve temperature was below a valve temperature threshold, and would be set in the open position when the detected valve temperature was above the valve temperature threshold. However, alternate embodiments can employ a drain valve 140 controlled in a different manner. For example, one alternate embodiment could have the drain valve 140 move between the open and closed positions based on instructions from the controller 160.

The fan motor 150 operates to rotate the fan blade 155 based on instructions from the controller 160.

The fan blade 155 operates to blow air onto the outdoor coil 115. Typically this air will generally be outdoor air that is being blown over the outdoor coil 115 so that it can exchange heat with the outdoor coil 115 to either remove waste heat from the air-conditioner 110 in a cooling mode or absorb heat from the outdoor air in a heating mode. Generally, the air-conditioner 100 will include multiple fan blades 155 arranged in a regular pattern extending from a rotor of the fan motor 150.

The fan blade 155 also includes a mechanism for picking up water from the drain pan 120 and moving that water onto the outdoor coil 115. In one embodiment, the fan blade includes a slinger ring on the fan blade 155. The slinger ring is designed to draw water from the drain pan 120 to the fan blade 155, which throws the water against the outdoor coil 115. When the air-conditioner 100 is operating in a cooling mode, the outdoor coil 115 will be operating as a condenser coil, and will be relatively warm with respect to the temperature of the indoor coil 110. As a result, water throne onto the outdoor coil 115 will typically evaporate from the coil rather than dripping back down into the drain pan 120, and can potentially serve to cool the outdoor coil 115, improving its performance. Furthermore, the fan blade 155 will typically spin fast enough that will remove water from the drain pan 120 more quickly than condensate can drip into the drain pan 120. Thus, when the slinger ring on the fan blade 155 is operating to remove water from the drain pan 120, the water level in the drain pan 120 will not rise.

The controller 160 operates to control the operation of at least the drain pump 130 and the fan motor 150. In other embodiments, it can also operate to control the drain valve 140, the pipe heater 165, the pump heater 170, and/or the pan heater 175. The controller 160 can also serve to operate the indoor and outdoor coils 110, 115, determining what mode they operate in. The controller 160 may be a microprocessor (e.g., a microcomputer), an application-specific integrated circuit (ASIC), a field-programmable gate array (FPGA), any suitable device for controlling the operation of the elements of the air-conditioner 100.

The pipe heater 165 is either proximate to or connected to the drain pipe 135 and operates to selectively heat the drain pipe 135 and any liquid passing through the drain pipe 135.

The pump heater 170 is either proximate to or connected to the drain pump 130 and operates to selectively heat the drain pump 130 and any liquid contained in the drain pump 130.

The pan heater 175 is either proximate to or connected to the drain pan 120 and operates to selectively heat the drain pan 120 and any liquid contained in the drain pan 120.

Although the embodiment of FIG. 1 includes all three of a pipe heater 165, a pump heater 170, and a pan heater 175, alternate embodiments can include any combination of these heaters 165, 170, 175, or none of the heaters 165, 170, 175 as desired. For example, some embodiments may wish to include only a single heater 165, 170, 175 to increase simplicity and reduce costs.

By having one or more of the pipe heater 165, the pump heater 170, and the pan heater 175, the air-conditioner 100 can effectively operate even when the temperature of the air-conditioner drops near or below the freezing point of water. In such case one or more of the heaters 165, 170, 175 can be operated to warm the water in one of the associated elements above its freezing point. In some embodiments the heaters 165, 170, 175 can be controlled by the controller 160. In alternate embodiments, one or more of the heaters 165, 170, 175 can be self-regulating heaters operating based on information from the temperature sensor 180, or in some cases containing an additional temperature sensor integral to the heater 165, 170, 175.

The temperature sensor 180 operates to detect an outdoor temperature of the outdoor air and provides that outdoor temperature information to the controller 160. Any desirable type of temperature sensor 180 could be used. For example, the temperature sensor 180 could be a negative temperature coefficient (NTC) thermistor, a resistance temperature detector (RTD), a thermocouple, a semiconductor-based sensor, or any other suitable temperature sensor.

In the disclosed embodiments, the drain pan 120 is a multiple-tiered drain pan that includes three ways to remove the water it collects: (1) the drain hole 120, which allows water to drain from the drain pan 120 to a controlled location (e.g., an external drain inside the building, or a location outside the building); (2) the drain pump 130, which can pump the water from the drain pan 120 onto the indoor coil 110; and (3) the fan blade 155, which can use its slinger ring to draw water from the drain pan 120 and throw it onto the outdoor coil 115.

Figure 2:
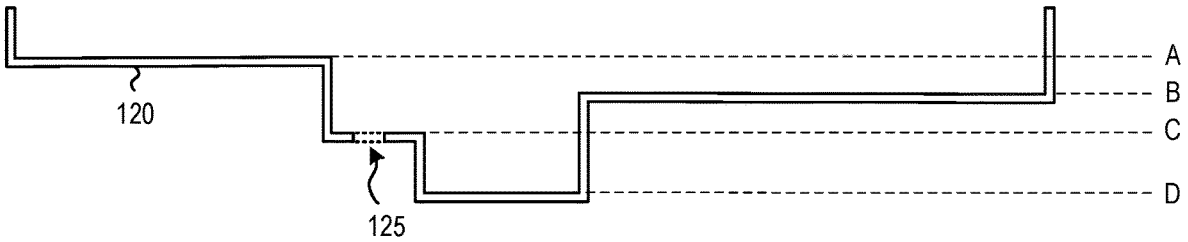
FIG. 2 is a side view of the drain pan of FIG. 1 according to disclosed embodiments.

FIG. 2 is a side view of the drain pan 120 of FIG. 1 according to disclosed embodiments. As shown in FIG. 2, the drain pan 120 includes multiple troughs having different depths (A-D).

Depth A is provided as a reference depth, and is the level of the drain pan 120 on which the indoor coil 110 rests. Depths B-D are identified with reference to depth A.

Depth B (the slinging depth) is the shallowest depth with respect to the reference depth A. Depth B is set such that when water is located in the trough having depth B (a slinger trough), the slinger ring on the fan blade 155 will contact the water in this trough, will grab the water from the drain pan 120, and will cause the fan blade 155 to throw the gathered water onto the outdoor coil 115.

Depth C (the draining depth) is the middle depth with respect to the reference depth A. The drain hole 125 is provided on a bottom surface of the trough in the drain pan 120 set at depth C (a draining trough). When water is located in the trough having depth C and the drain valve 140 is set in an open position, water will drain out of the drain pan 120 via the drain hole 125.

Depth D (the pumping depth) is the deepest depth with respect to the reference depth A and defines a lowest trough (a pumping trough). The drain pump 130 is and arranged such that it will pump water out of the pumping trough in the drain pan 120 at a point between depth C and depth D.

Thus, water will never reach depths A, B, or C in the drain pan 120 of FIG. 2 if the drain pump 130 is operating. As result, it will be unnecessary to drain water out of the drain hole 125 or to fling water onto the outdoor coil 115 using the slinger ring on the fan blade 155. Likewise, if the drain hole 125 is open, water will never reach depths A or B. As a result, it will be unnecessary to fling water onto the outdoor coil 115 using the slinger ring on the fan blade 155.

Figure 3:
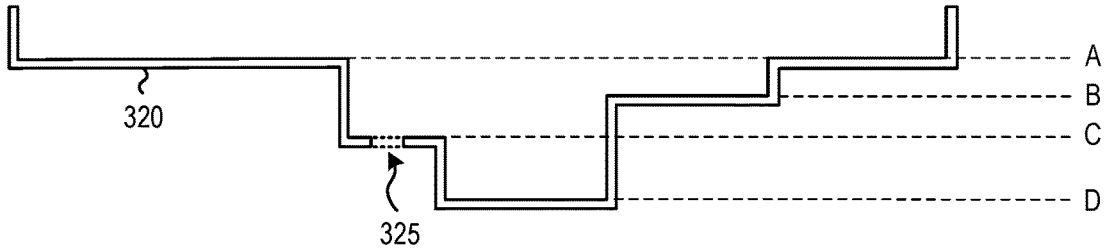
FIG. 3 is a side view of a drain pan according to alternate disclosed embodiments.

FIG. 3 is a side view of a drain pan 320 according to alternate disclosed embodiments. The drain pan 320 corresponds to the drain pan 120 in FIGS. 1 and 2 and serves the same purpose. As shown in FIG. 3, the drain pan 320 has four depths A-D, with depth A serving as a reference depth, depth B serving as a slinging depth, depth C serving as a draining depth, and depth D serving as a pumping depth. The fan blade 155 operates to throw water from the drain pan 320 when the water depth is between depths A and B; the drain hole 125 (when open) operates to drain water from the drain pan 320 when the water depth is at depth C or above; and the drain pump 130 (when operating) operates to pump water from the drain pan 320 to the indoor coil 110 when the water depth is between depths D and C.

The main difference between the drain pan 120 and the drain pan 320 is that the drain pan 320 is configured such that the indoor coil 110 and the outdoor coil 115 both rest on the drain pan 320 at the reference depth A, while the drain pan 120 is configured such that the indoor coil 110 rests on the drain pan 120 at the reference depth A and the outdoor coil 115 rests on the drain pan at the reference depth B.

Other variations in the configuration of the drain pan 120, 320 are possible, so long as at least three separate depths (B-D) are provided. For example, an alternate embodiment could place the indoor coil 110 at depth B.

Figure 4:
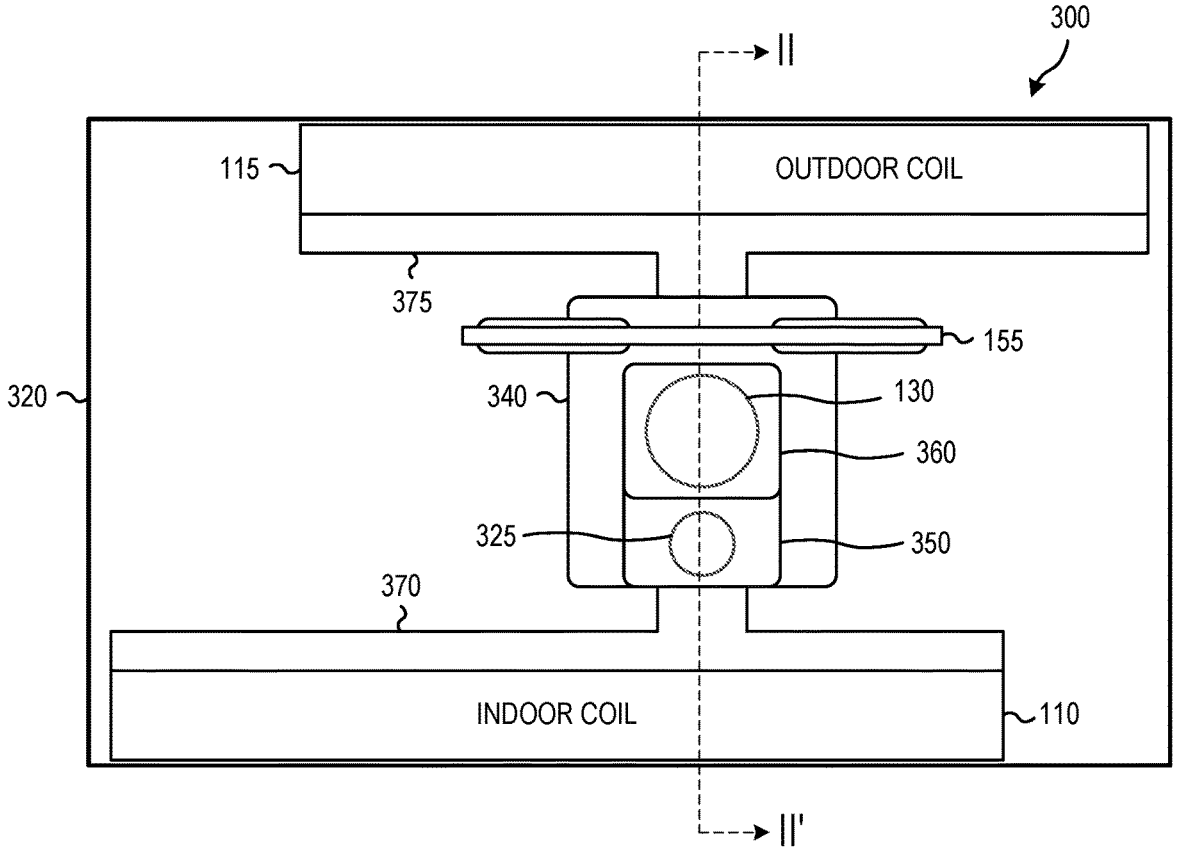
FIG. 4 is a top view of an air-conditioner having a drain pan according to disclosed embodiments.

FIG. 4 is a top view of an air-conditioner 300 having a drain pan 320 according to disclosed embodiments. As shown in FIG. 4, the air-conditioner 300 includes an indoor coil 110, an outdoor coil 115, a drain pump 130, a fan blade 155, and a drain pan 320. Although not shown in FIG. 4, the air-conditioner 300 also includes a drain pipe 135, a drain valve 140, a fan motor 150, a controller 160, and a temperature sensor 180, and may include one or more of a pipe heater 165, pump heater 170, and pan heater 175. These elements are not shown in FIG. 4 to allow a better view of the drain pan 320.

Elements with the same reference numbers as elements in the air-conditioner 100 of FIG. 1 operate as described above with respect to FIG. 1. The drain pan 320 operates as described above with respect to FIG. 3.

As shown in FIG. 4, the drain pan 320 includes a slinger trough 340, a draining trough 350, a pumping trough 360, an indoor discharge pathway 370, and an outdoor discharge pathway 375.

The indoor discharge pathway 370 is provided underneath the indoor coil 110 and connected to at least one of the troughs 340, 350, 360 such that water dripping from the indoor coil 110 will initially fall into the indoor discharge pathway 370 before flowing into one of the troughs 340, 350, 360. Similarly the outdoor discharge pathway 375 is provided underneath the outdoor coil 115 and is connected to at least one of the troughs 340, 350, 360 such that water dripping from the outdoor coil 115 will initially fall into the outdoor discharge pathway 375 before flowing into one of the troughs 340, 350, 360.

The indoor discharge pathway 370 and the outdoor discharge pathway 375 are provided at the reference depth A, which is higher than the slinging depth B, the draining depth C, and the pumping depth D. In some embodiments, the bottom surface of the discharge pathways 370, 375 can be slanted toward the troughs 340, 350, 360 to make it easier for water to flow from the discharge pathways 370, 375 to the troughs 340, 350, 360.

The slinger trough 340 is provided at a slinging depth B that is lower than the reference depth A. The slinging trough 340 is arranged such that the draining trough 350 and the pumping trough 360 are contained within the slinging trough 340. Likewise, the slinging trough 340 is arranged such that a bottom portion of the fan blade 155 will contact water contained in the slinging trough 340. As a result, when the fan blade 155 is rotating and water is in the slinging trough 340, a slinger ring on the fan blade 155 will grab water from the slinging trough 340 and throw it onto the outdoor coil 115.

The draining trough 350 is provided at a draining depth C that is lower than both the reference depth A and the slinging depth B. The draining trough 350 includes a drain hole 325 on its bottom surface through which water can drain when it is at a depth at or above the draining depth C. Although not shown in FIG. 4, a drain valve 140 is provided that can selectively open or close the drain hole 325. As a result, water will only flow through the drain hole 325 when water in the drain pan 320 is at or above the draining depth C and the drain valve 140 has set the drain hole 325 in an open state.

Furthermore, as shown in FIG. 4, the draining trough 350 and the pumping trough 360 are contained within the boundaries of the slinging trough 340, and the pumping trough 360 is contained within the boundaries of the draining trough 350. In this way, water will collect first in the pumping trough 360, then in the draining trough 350 only when the pumping trough 360 fills, and then in the slinging trough 340 only when the pumping trough 360 and the draining trough 350 fill.

Because the pumping depth D is lower than all of the reference depth A, the slinging depth B, and the draining depth C, water should never rise higher than depth C when the drain pump 130 is operational. This means that when the drain pump 130 is operational, no water can drain through the drain hole 325 (regardless of whether it is open or closed) and no water can be thrown by the slinger ring on the fan blade 155 onto the outdoor coil 115. Similarly, because the draining depth C is lower than both the reference depth A and the slinging depth B, when the drain valve 140 has set the drain hole 325 in an open state water should never rise higher than depth B. This means that when the drain valve 140 has set the drain hole 325 in an open state, no water can be thrown by the slinger ring on the fan blade 155 onto the outdoor coil 115. Finally, because the slinging depth B is lower than the reference depth A, when the fan motor 150 is causing the fan blade 155 to rotate water should never rise higher than depth A.

Given that each of the fan blade 155, the drain valve 325, and the drain pump 130 typically remove more water than can drip from the indoor or outdoor coils 110, 115, no water will ever reach the reference depth A when either the fan blade 155 is rotating, the drain valve 325 is open, or the drain pump 130 is operating.

Although not shown in the cross-sectional view of FIG. 3, the drain pan 320 may include a further level above depth A, i.e., a depth at which the indoor coil 110 and the outdoor coil 115 are resting. This portion of the drain pan 320 may remain dry as it is above the slinger trough 340 and the indoor and outdoor discharge pathways 370, 375. Alternative embodiments can simply provide a single level of the drain pan 320 on which the indoor coil 110 and the outdoor coil 120 rest. Such embodiments could provide a bottom surface of the drain pan 320 outside of the troughs 340, 350, 360 that is not level, but is slanted toward the troughs 340, 350, 360 such that water falling into the drain pan 320 will flow toward the troughs 340, 350, 360.

Figure 5:
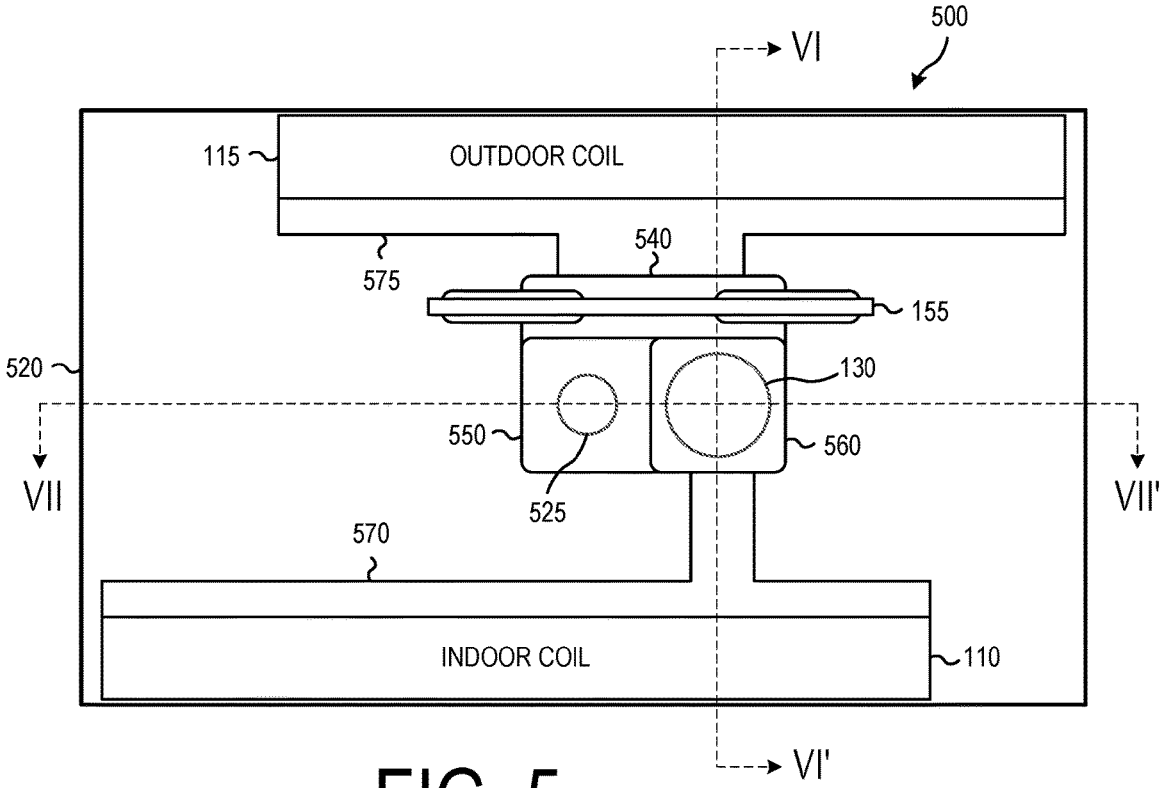
FIG. 5 is a top view of an air-conditioner having a drain pan according to alternate disclosed embodiments.

FIG. 5 is a top view of an air-conditioner having a drain pan according to alternate disclosed embodiments. As shown in FIG. 5, the air-conditioner 500 includes an indoor coil 110, and outdoor coil 115, a drain pump 130, a fan blade 155, and a drain pan 520. Although not shown in FIG. 5, the air-conditioner 500 also includes a drain pipe 135, a drain valve 140, a fan motor 150, a controller 160, and a temperature sensor 180, and may include one or more of a pipe heater 165, pump heater 170, and pan heater 175. These elements are not shown in FIG. 5 to allow a better view of the drain pan 520.

As shown in FIG. 5, the drain pan 520 includes a slinger trough 540, a draining trough 550, a pumping trough 560, an indoor discharge pathway 570, and an outdoor discharge pathway 575.

Elements with the same reference numbers as elements in the air-conditioner 100 of FIG. 1 operate as described above with respect to FIG. 1. The drain pan 520 is similar to the drain pan 320 of FIGS. 3 and 4 save that the arrangement of the slinger trough 540, the draining trough 550, the pumping trough 560, the indoor discharge pathway 570, and the outdoor discharge pathway 575 are different. The drain pump 130 is located in the pumping trough 560 such that it can pump water out of the pumping trough 560; a drain hole 525 is located on a bottom surface of the draining trough 550 such that water can drain out of the drain hole 525; the drain valve 140 is located in the draining trough 550 such that the drain valve 140 can selectively open or close the drain hole 525; and the fan blade 155 is arranged such that a slinger ring on the fan blade 155 can throw water from the slinging trough 540 onto the outdoor coil 115.

Aside from the difference in placement, the slinger trough 540 operates similarly to the slinger trough 340, the draining trough 550 operates similarly to the draining trough 350, the pumping trough 560 operates similarly to the pumping trough 360, the indoor discharge pathway 570 operates similarly to the indoor discharge pathway 370, and the outdoor discharge pathway 575 operates similarly to the outdoor discharge pathway 375.

Figure 6:
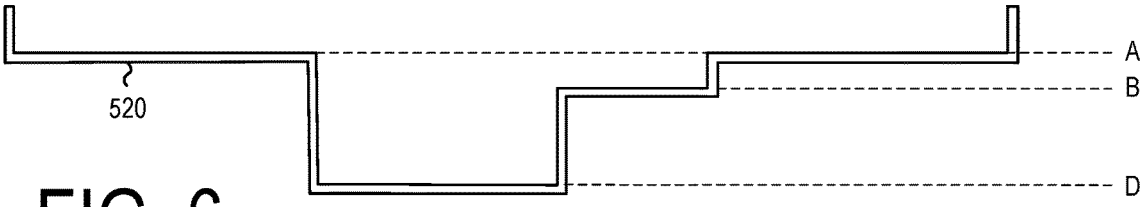
FIG. 6 is a side view of the drain pan of FIG. 5 along the line VI-VI'.
Figure 7:
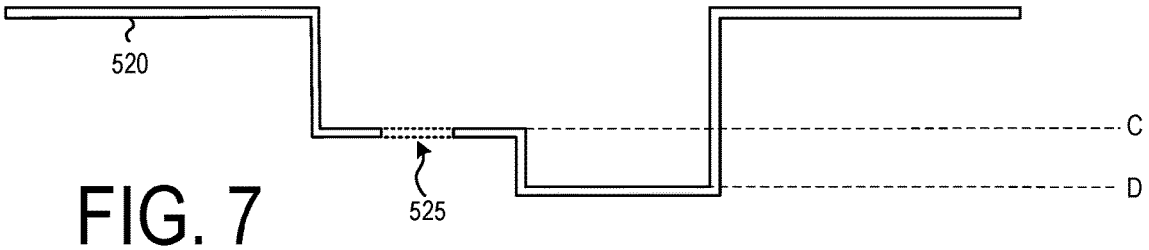
FIG. 7 is a side view of the drain pan of FIG. 5 along the line VII-VII'.

FIG. 6 is a side view of the drain pan 520 of FIG. 5 along the line VI-VI'. FIG. 7 is a side view of the drain pan 520 of FIG. 5 along the line VII-VII'. As shown in FIGS. 6 and 7, the slinging trough 540 forms a rectangle underneath the fan blade 155 and between the indoor discharge pathway 570 and the outdoor discharge pathway 575. The draining trough 550 is formed in a lower portion of the slinging trough 540 (as viewed in FIG. 5), and the pumping trough 560 is formed in a lower right portion of the slinging trough 540 (as viewed in FIG. 5).

The embodiments of FIGS. 1-7 illustrate that there are multiple ways of arranging a multiple-level drain pan. These are by way of example only. Numerous other arrangements are possible, provided that a slinging trough, a draining trough, and a pumping trough are provided in a drain pan at three different levels, with the pumping trough having a depth lower than the slinging trough and the draining trough, and the draining trough having a depth lower than the slinging trough. Furthermore, the slinging trough, the draining trough, and the pumping trough should be connected such that water will first settle in the pumping trough, will overflow into the draining trough when the pumping trough is filled, and will overflow into the slinging trough when the pumping trough and the draining trough are filled.

Operational Modes of the Air-Conditioner

Figure 8:
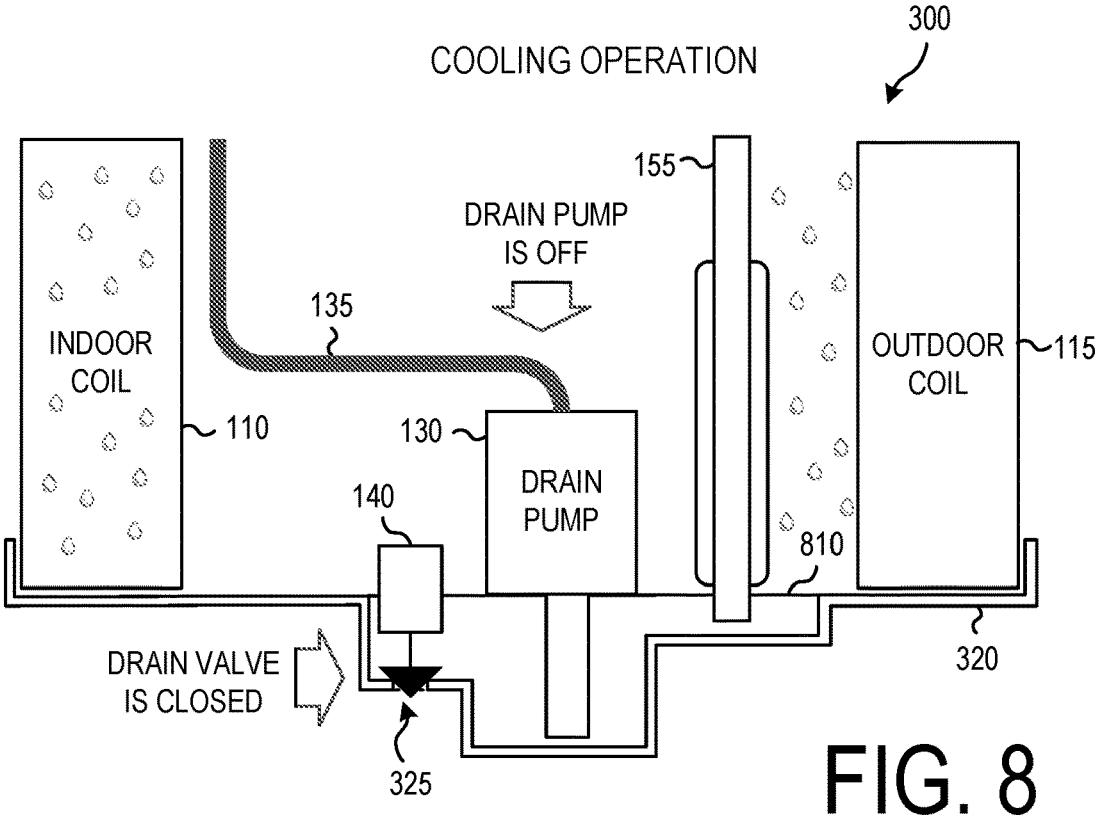
FIG. 8 is a block diagram of an air-conditioner during a cooling operation according to disclosed embodiments.
Figure 9:
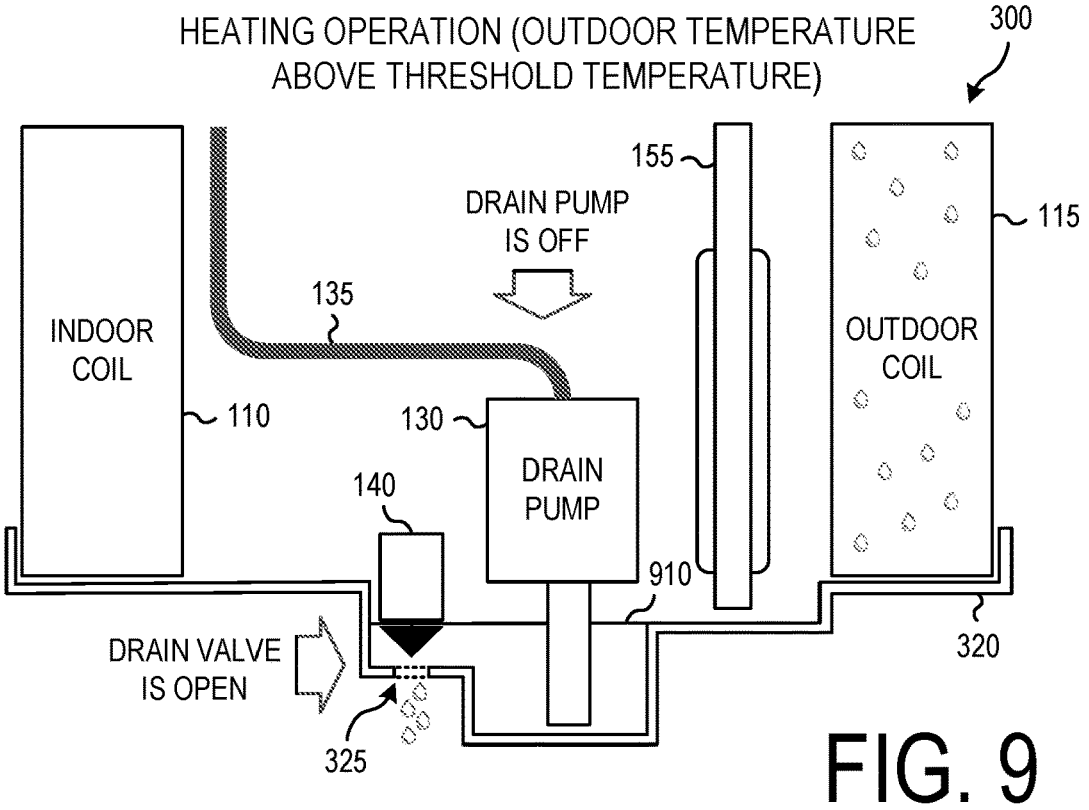
FIG. 9 is a block diagram of an air-conditioner during a heating operation when an outside temperature is above a threshold temperature according to disclosed embodiments.
Figure 10:
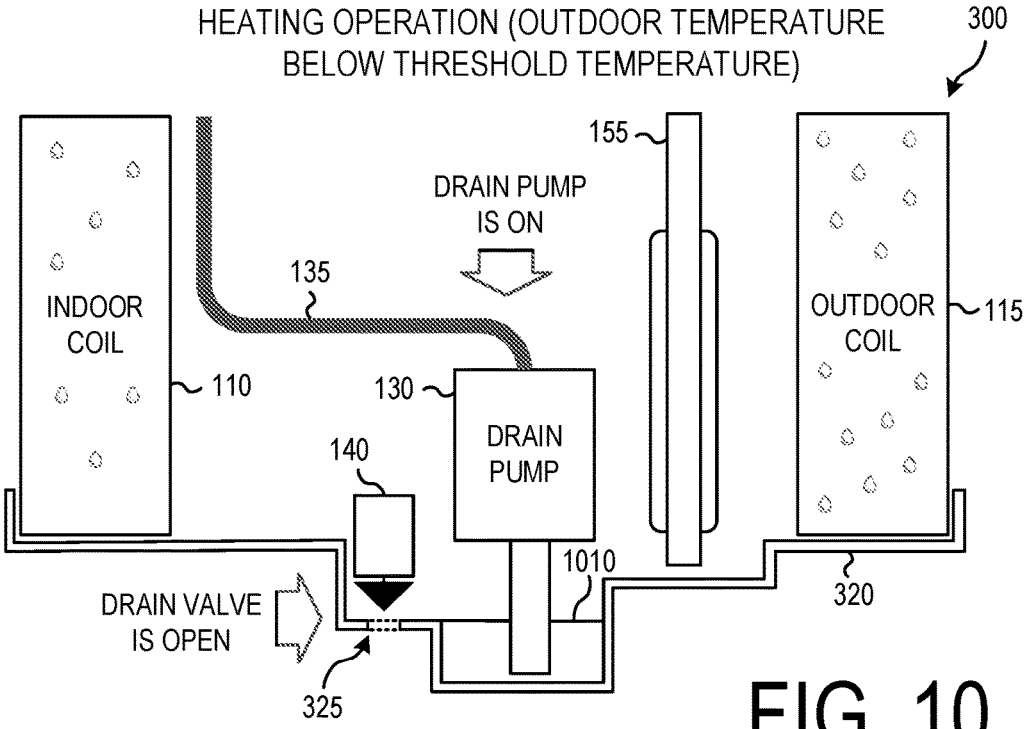
FIG. 10 is a block diagram of an air-conditioner during a heating operation when an outside temperature is below a threshold temperature according to disclosed embodiments.

FIGS. 8-10 are block diagrams showing the operation of the air-conditioner 300 during different operational modes and at different temperatures. FIGS. 8-10 only show a lower portion of the air-conditioner 300 for ease of disclosure and explanation. Specifically, FIGS. 8-10 show the indoor coil 110, the outdoor coil 115, the drain pan 320, the drain pump 130, the drain pipe 135, the drain valve 140, and the fan blade 155. Although not shown, the fan motor 150, the controller 160, and the temperature sensor 180 operate as disclosed above with respect to FIGS. 1-7. Likewise, although FIGS. 8-10 do not show any of the heaters 165, 170, 175, various embodiments can include one or more of these heaters 165, 170, 175, which operate as set forth above with respect to FIGS. 1-7.

As shown in FIGS. 8-10, the air-conditioner 300 operates in three different modes: (1) during a cooling operation; (2) during a heating operation when an outside temperature is above a threshold temperature; and (3) during a heating operation when the outside temperature is below the threshold temperature.

FIG. 8 is a block diagram of an air-conditioner 300 during a cooling operation according to disclosed embodiments. During the cooling operation, the indoor coil 110 acts as an evaporator coil and is cooler than the indoor air, while the outdoor coil 115 acts as a condenser coil and is warmer than the outdoor air. As a result, water will condense from the indoor air onto the indoor coil 110 and drip into the drain pan 320.

As shown in FIG. 8, the drain pump 130 is turned off and the drain valve 140 is set to be closed during the cooling operation. If the drain valve 140 is a temperature-controlled drain valve, the valve temperature threshold at which the drain valve is set to be open will typically be much lower than a temperature at which a cooling operation would be selected for the air-conditioner 100, 300. For example, the valve temperature threshold would typically be at or near the freezing point of water (0° C.), while the temperature at which the air-conditioner 100, 300 would enter a cooling mode would be much higher than the freezing point of water (e.g., 15-20° C.).

As a result of this configuration, the drain pump 130 does not pump any water out of the pumping trough 360 in the drain pan 320, and no water drains out through the drain hole 325 from the draining trough 350 in the drain pan 320. Instead, the water that condenses on the indoor coil 110 and drips into the drain pan 320 will rise to a first water level 810 and at least partially fill the slinging trough 340 in the drain pan 320. The slinger ring on the fan blade 155 will then draw water from the slinging trough 340 in the drain pan 320 and throw it onto the outdoor coil 115. Since the outdoor coil is generally warmer than the outdoor air during the cooling operation, the water thrown onto the outdoor coil 115 will fully or partially evaporate before it can drip back into the drain pan 320. In addition to removing the water from the drain pan 320, this can also serve to cool down the outdoor coil, improving the efficiency of the air-conditioning operation.

In this way water can be removed from the drain pan 320 in such a way that it will not return to the drain pan 320. Furthermore, since the amount of water tossed by the slinger ring on the fan blade 155 is generally greater than the amount of water that will condense on the indoor coil and drip into the drain pan 320, this operation will keep the water that collects in the drain pan 320 from overflowing over the sides of the drain pan 320. Whenever the water rises to partially fill the slinging trough 340 in the drain pan 320 the slinger ring on the fan blade 155 will remove water from the drain pan 320 until there is none left in the slinging trough.

FIG. 9 is a block diagram of an air-conditioner during a heating operation when an outside temperature is above a threshold temperature according to disclosed embodiments. The threshold temperature will typically be the freezing point of water (0° C. at sea level) or a temperature slightly above the freezing point of water (e.g., 1-5° C.). When the outside temperature is above this temperature threshold, there is no danger of the water fully or partially freezing either in the drain pan 320 or near the drain hole 325 of the drain pan 320. Therefore, it is safe to allow water to drain from the drain hole 325.

During the heating operation when the outside temperature is above the threshold temperature, the indoor coil 110 acts as a condenser coil and is warmer than the indoor air, while the outdoor coil 115 acts as an evaporator coil and is cooler than the outdoor air. As a result, water will condense on the outdoor coil 115 and drip into the drain pan 320 and rise to a second water level 910.

As shown in FIG. 9, the drain pump 130 is turned off and the drain valve 140 is set to be open during the heating operation when the outside temperature is above the threshold temperature. If the drain valve 140 is a temperature-controlled drain valve, the valve temperature threshold at which the drain valve is set to be open will typically be much lower than a temperature at which a cooling operation would be selected for the air-conditioner 100, 300. For example, the valve temperature threshold would typically be at or near the freezing point of water (0° C.), while the temperature at which the air-conditioner 100, 300 would enter a cooling mode would be much higher than the freezing point of water (e.g., 15-20° C.).

As a result of this configuration, the drain pump 130 does not pump any water out of the pumping trough 360 in the drain pan 320. Instead, the water that condenses on the indoor coil 110 and drips into the drain pan 320 will rise to at least partially fill the draining trough 350 in the drain pan 320. This water will then drain out through the open drain hole 325 from the draining trough 350 in the drain pan 320.

In this way water can be removed from the drain pan 320 in such a way that it will not return to the drain pan 320. Also, since the amount of water per unit time that drains through the drain hole 325 is generally greater than the amount of water per unit time that will condense on the indoor coil and drip into the drain pan 320, this operation will keep the water that collects in the drain pan 320 from overflowing over the sides of the drain pan 320. Whenever the water rises to partially fill the draining trough 350 in the drain pan 320 the water will flow out of the drain hole to wherever has been designated for drained water. This also means that the water in the drain pan 320 should never rise to the level of the slinger trough 340 in this mode of operation. As a result, the slinger ring on the fan blade 155 will never grab water from the drain pan 320 and throw it onto the outside coil 115.

Furthermore, since the outside temperature is above the threshold temperature (somewhere near the freezing point of water), the drained water will not freeze and thereby cause difficulty.

FIG. 10 is a block diagram of an air-conditioner during a heating operation when an outside temperature is below a threshold temperature according to disclosed embodiments. When the outside temperature is below this temperature threshold, there is a danger of the water fully or partially freezing either in the drain pan 320 or near the drain hole 325 of the drain pan 320. Therefore, it is not safe to allow water to drain from the drain hole 325.

During the heating operation when the outside temperature is below the threshold temperature, the indoor coil 110 acts as a condenser coil and is warmer than the indoor air, while the outdoor coil 115 acts as an evaporator coil and is cooler than the outdoor air. As a result, water will condense on the outdoor coil 115 and drip into the drain pan 320 and rise to a third water level 1010. In some cases, the water will form on the outdoor coil 115 as Frost, which must've than to be melted by a defrosting operation. Regardless, water should still drip from the outdoor coil 115 to the drain pan 320 during a heating operation when the outside temperature is below the threshold temperature.

As shown in FIG. 10, the drain pump 130 is turned on and the drain valve 140 is set to be open during the heating operation when the outside temperature is below the threshold temperature. As a result, the drain pump 130 will pump any water that condenses from the indoor coil 110 and drips into the drain pan 320 out of the pumping trough 360 in the drain pan 320 and deposit it over the indoor coil 110. Since the indoor coil 110 will be warmer than the indoor air in this mode of operation, the water pumped onto the indoor coil 110 will fully or mostly evaporate rather than drip back down into the drain pan 320. In this way, the treated indoor air provided to an indoor space will be humidified, which is often desirable during a heating operation.

In this way water can be removed from the drain pan 320 in such a way that it will not return to the drain pan 320. Furthermore, since the pump 130 will typically pump water faster than water can drip from the indoor coil 110, this operation will keep the water that collects in the drain pan 320 from overflowing over the sides of the drain pan 320. Whenever the water rises to partially fill the pumping trough 360 the drain pump 140 will operate to pump water out of the pumping trough 360. Thus, the water in the drain pan 320 should never rise to the level of the draining trough 350 or the slinger trough 340 in this mode of operation. As a result, no significant amount of water should be supplied to the drain hole 325 and the slinger ring on the fan blade 155 will never grab water from the drain pan 320 and fling it on the outside coil 115.

Furthermore, even though the outdoor temperature may be near or below the freezing point of water, the drain pump 130 may operate to pump the water quickly enough that the water will be pumped out of the pumping trough 360 before it has a chance to freeze. In embodiments in which this is not the case, some combination of the pipe heater 165, pump heater 170, and pan heater 175 can operate to keep the water in the drain pan 320, drain pump 130, and drain pipe 135 warm enough that it will not freeze.

In this way, water can safely be removed from the drain pan 320 during any mode of operation. By having at least three tiers of troughs in the drain pan 320, the disclosed air-conditioner design 300 can provide a hierarchy of removal schemes that can be applied, as needed, to a number of different situations. In the embodiment disclosed above the drain pump 130 operates on the water on the lowest tier, and therefore will remove water from the drain pan 320 before the drain hole 325 or the slinger ring on the fan blade 155 can remove water from the drain pan 320. The drain hole 325 operates on the water in the middle tier, and therefore will remove water from the drain pan 320 before the slinger ring on the fan blade 155 can remove water from the drain pan 320. The slinger ring on the fan blade 155 only removes water from the drain pan 320 when both the drain hole 325 and the drain pump 130 are not operating to remove water from the drain pan 320.

Cleaning Cycle of the Air-Conditioner

The disclosed air-conditioner 100, 300 with a multiple-tiered drain pan 120, 320 can also be used to assist with a cleaning cycle for the air-conditioner 100, 300. Such an operation is typically performed on an air-conditioner 100, 300 when the temperature is relatively warm (e.g., above 20-25° C.). This would make certain that no liquid would freeze within the air-conditioner 100, 300, that the indoor coil 110 would operate as an evaporator coil and would be cooler than the indoor air, and that the outdoor coil 115 would act as a condenser coil and would be warmer than the outdoor air.

FIGS. 11-14 are block diagrams showing the operation of the air-conditioner 300 at different times during a cleaning cycle. FIGS. 11-14 only show a lower portion of the air-conditioner 300 for ease of the disclosure and explanation. Specifically, FIGS. 11-14 show the indoor coil 110, the outdoor coil 115, the drain pan 320, the drain pump 130, the drain pipe 135, the drain valve 140, and the fan blade 155. Although not shown, the fan motor 150, the controller 160, and the temperature sensor 180 operate as disclosed above with respect to FIGS. 1-7. Likewise, although FIGS. 11-14 do not show any of the heaters 165, 170, 175, various embodiments can include one or more of these heaters 165, 170, 175, which operate as set forth above with respect to FIGS. 1-7.

Figure 11:
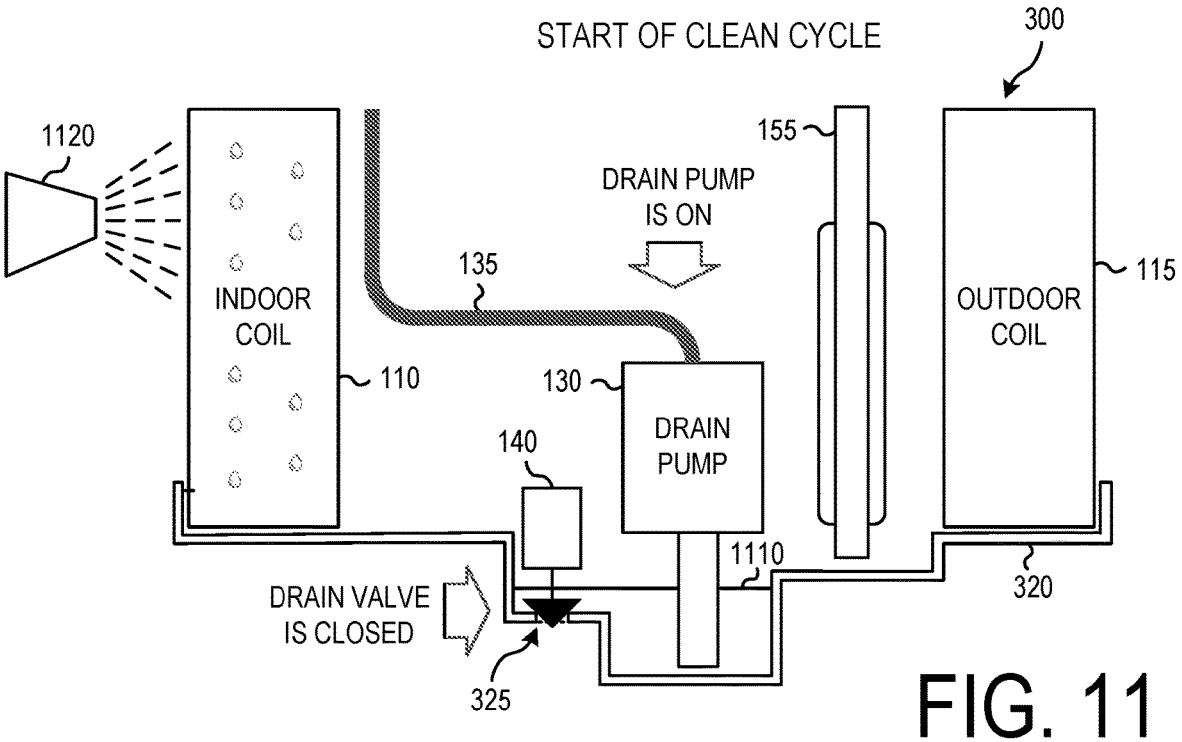
FIG. 11 is a block diagram of an air-conditioner during a start of a cleaning cycle according to disclosed embodiments.

FIG. 11 is a block diagram of an air-conditioner 300 during a start of the cleaning cycle according to disclosed embodiments. The cleaning cycle starts with the air-conditioner 300 off and the indoor coil 110 dry. An operator May begin by vacuuming the surface of the indoor coil 110 to remove particles from the indoor coil 110. The operator then sprays a non-foaming coil cleaning solution onto the indoor coil 110 using a sprayer 1120 (e.g., a hand sprayer). The operator then allows the coil cleaning solution to remain on the indoor coil 110 for an initial period of time (e.g., 3-10 minutes).

After the initial period of time ends, the operator then turns the air-conditioner 300 on in a cleaning cycle, whereby the air-conditioner operates in a cooling mode. This will cause the indoor coil 110 to operate as an evaporator coil and become cooler than the indoor air. The air-conditioner should be operated such that the temperature of the indoor coil 110 is sufficiently low that water will condense on the indoor coil 110. This water will then drip down the indoor coil 110 into the drain pan 320 and collect in the pumping trough 360 and rise to a first cleaning water level 1110. As it drips, the water will operate to partially clean the coil cleaning solution off the indoor coil 110. As a result, the liquid that collects in the drain pan 320 will be a water-cleaning solution mixture.

During the start of the cleaning cycle, the drain pump 130 will be turned on and the drain valve 140 will be set to close the drain hole 325. As a result, liquid (the water-cleaning solution mixture) will begin to collect in the drain pan 320, starting in the pumping trough 360 and then filling the draining trough 350. Because the drain pump 130 is pumping the liquid from the drain pan 320 onto an indoor coil 110 that is operating as an evaporating coil and is cooler than the indoor air, none of the liquid will evaporate. Rather, it will join the water condensing on the indoor coil 110 and both the condensed water and the pumped liquid will flow down the indoor coil 110, removing cleaning solution from the indoor coil as they do. This means that despite the fact that the drain pump 130 is in operation, liquid will continue to collect in the drain pan 320 and the liquid level 1110 in the drain pan 320 will continue to rise. However, since the drain valve 140 is set to keep the drain hole 325 closed, even when the liquid level 110 rises such that the liquid starts to fill the draining trough 350, none of the liquid will drain out through the drain hole 325.

The precise ratio of water to cleaning solution in the liquid collecting in the drain pan 320 will vary depending upon how much water has condensed on the indoor coil 110 and how much cleaning solution has been washed off of the indoor coil 110. However, since water will continue to be added to the system by condensation while none will be expelled from the system, the amount of water in the system will continue to rise compared to the amount of cleaning solution in the system. If all of the cleaning solution is removed from the indoor coil 110, the ratio of water to cleaning solution in the collected liquid will thus rise.

Figure 12:
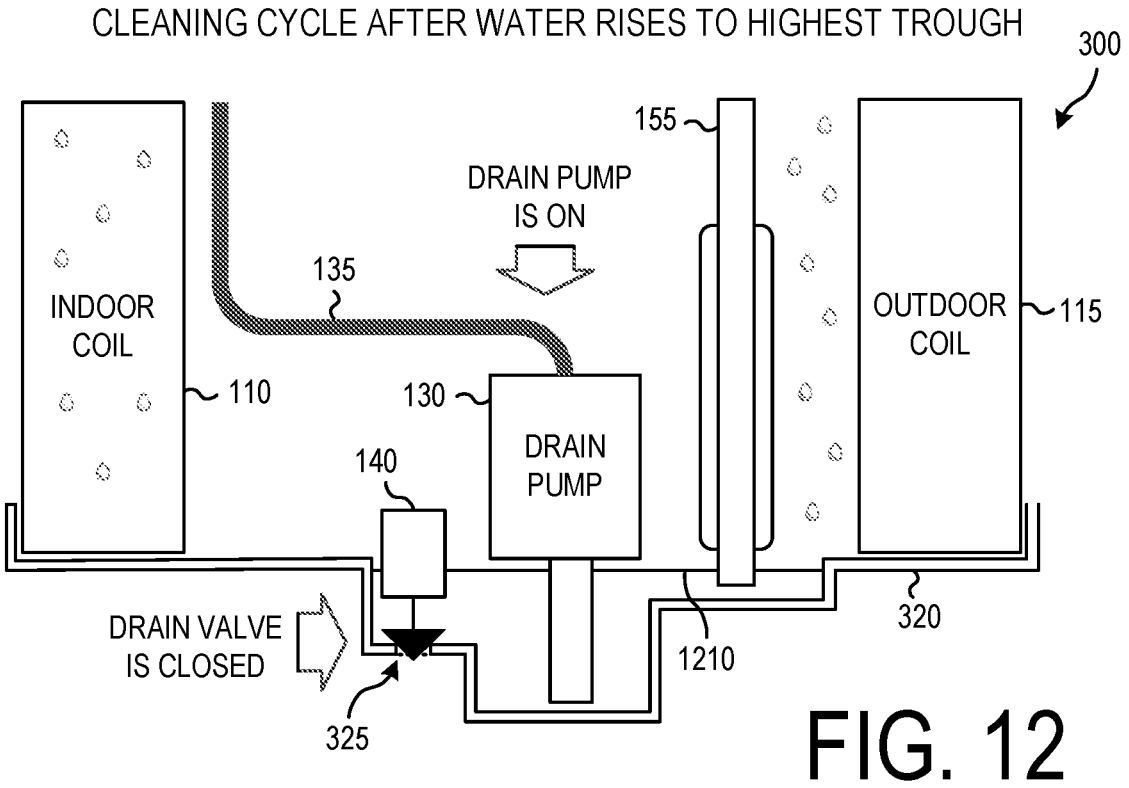
FIG. 12 is a block diagram of an air-conditioner during a cleaning cycle after water rises to a highest trough according to disclosed embodiments.

FIG. 12 is a block diagram of an air-conditioner 300 during cleaning cycle after water rises to a highest trough according to disclosed embodiments. As the amount of water added to the system by condensation increases, the liquid level 1210 in the drain pan 320 will continue to rise. Eventually, it will reach a level at which liquid (the water-cleaning solution mixture) is contained in the slinging trough 340. Typically, this will occur once the cleaning cycle has been operation for about 10-15 minutes. However, differences in temperature and humidity may cause this time to vary.

At this point, the slinger ring on the fan blade 155 will begin to grab liquid from the slinging tough 340 and toss it onto the outdoor coil 115. Since the outdoor coil 115 is operating as a condenser coil and will be warmer than the outside air, this will cause the liquid tossed onto the outdoor coil 115 to mostly evaporate. As a result, little to none of the tossed liquid will drip back into the drain pan 320.

At this point in the cleaning operation the drain pump 130 is still on. Thus, liquid will still be pumped from the drain pan 320 onto the indoor coil 110. Water will also continue to condense on the indoor coil 110. The combination of pumped liquid and condensed water will have the continuing effect of washing any remaining cleaning solution off of the indoor coil 110.

Furthermore, once the last of the cleaning solution is wiped from the indoor coil 110, the ratio of water to cleaning solution in the liquid collected in the drain pan 320 will rise. This is because the slinger ring on the fan blade 155 will operate to continually remove some of the liquid (the water-cleaning solution mixture) while water will continue to condense on the indoor coil 110 and drip into the drain pan 320. This will have the effect of repeatedly removing some of the cleaning solution from the liquid contained in the drain pan 320 while adding water to the liquid.

Figure 13:
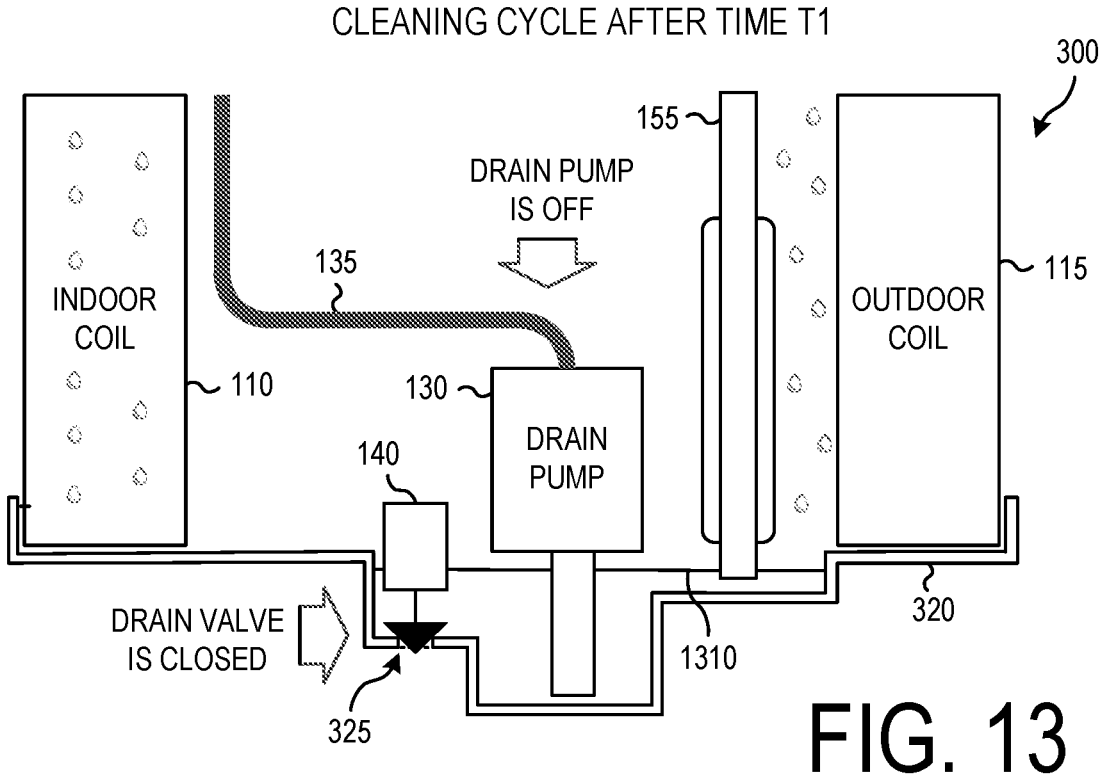
FIG. 13 is a block diagram of an air-conditioner during a cleaning cycle after a time T1 according to disclosed embodiments.

FIG. 13 is a block diagram of an air-conditioner 300 during a cleaning cycle after a time T1 according to disclosed embodiments. The time T1 represents a time after which it is assumed that a large amount of the cleaning solution has been removed from the indoor coil 110. In one embodiment the time T1 can be set to be between 30-60 minutes, though this is by way of example only. Alternate embodiments could choose a different time for T1.

Once the time T1 has expired and it is determined that a large amount of the cleaning solution has been removed from the indoor coil 110, the drain pump 130 is turned off. The drain valve 140 remains in the closed position. However, since the air-conditioner 300 is still operating in a cooling mode, the indoor coil 110 will continue to operate as an evaporator. Water will therefore continue to condense on the indoor coil 110 and drip into the drain pan 320, collecting in the slinging, draining, and pumping troughs 340, 350, 360. This will have the effect of continuing to remove any remaining cleaning solution from the indoor coil 110.

During this portion of the cleaning cycle, the slinger ring on the fan blade 155 will continue to take liquid from the slinging trough 340 in the drain pan 320 and throw it onto the outdoor coil 115 where it will evaporate, and the indoor coil 110 will continue to add condensed water to the drain pan 320. Since there should be very little cleaning solution remaining on the indoor coil 110 this will cause the ratio of water to cleaning solution in the liquid gathered in the drain pan 320 to rise.

Figure 14:
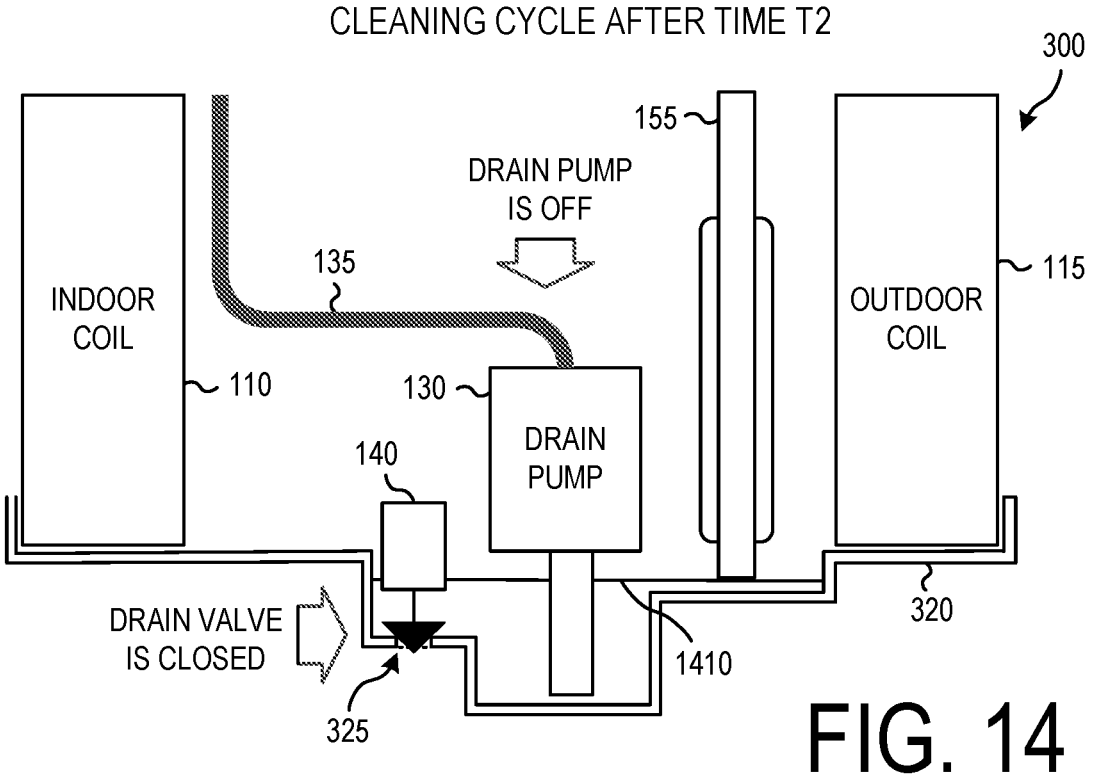
FIG. 14 is a block diagram of an air-conditioner during a cleaning cycle after a time T2 according to disclosed embodiments.

FIG. 14 is a block diagram of an air-conditioner 300 during a cleaning cycle after a time T2 according to disclosed embodiments. The time T2 is determined to be a time after which there should be little to no cleaning solution remaining on the indoor coil 110. In one embodiment the time T2 can be set to 45-90 minutes, though this is by way of example only. Alternate embodiments could choose a different time for T2. Regardless, whatever times are selected for T1 and T2, the value of T2 must be greater than the value of T1.

By time T2, the indoor coil 110 should be thoroughly rinsed clean of the cleaning solution, and the ratio of water to cleaning solution in the liquid contained in the drain pan 320 should be very high. In other words, what cleaning solution remains in the liquid in the drain pan 32 should be highly diluted, and no cleaning solution should remain on the indoor coil 110.

At time T2, the air-conditioner 300 shuts off until such a time it is needed for normal operation. The cleaning cycle is now complete. Liquid remains in the drain pan 320 after completion of the cleaning cycle, though the liquid is mostly water. This liquid can be disposed of during normal operation as noted above, or could be removed in another way prior to normal operation.

Normal Operation of the Air-Conditioner

Figure 15:
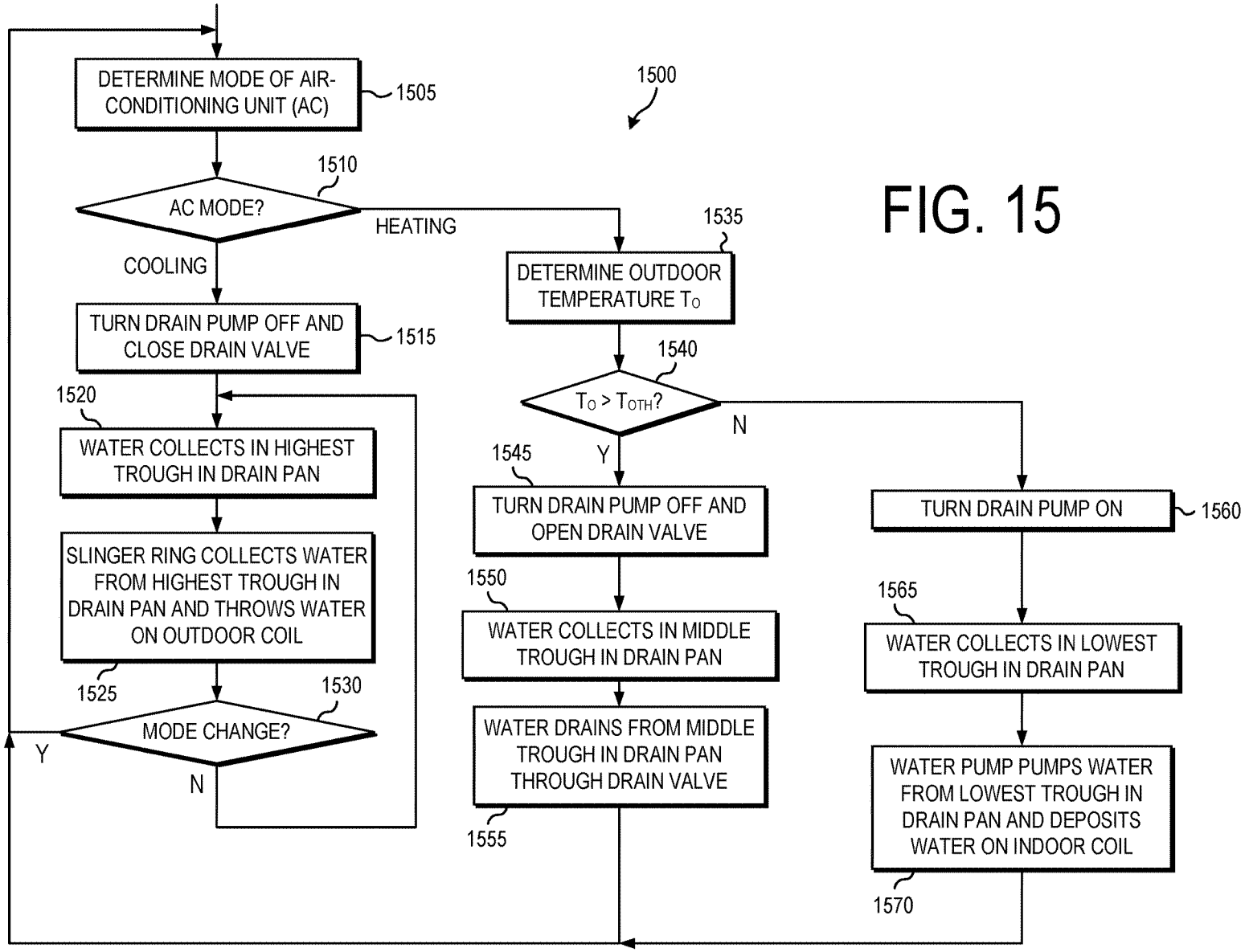
FIG. 15 is a flow chart of the operation of an air-conditioner having a multiple-tiered drain pan according to disclosed embodiments.

FIG. 15 is a flow chart of the operation 1500 of an air-conditioner (AC) having a multiple-tiered drain pan according to disclosed embodiments. The drain pan will have at least three connected troughs, a lowest trough, a middle trough, and a highest trough. This AC will have a drain pump operable to selectively pump water out of the lowest trough of the drain pan onto an indoor coil, a drain hole and associated drain valve operable to selectively allow liquid to drain out of the middle trough of the drain pan, and a fan blade with a slinger ring operable to take liquid from the highest trough of the drain pan and throw it onto an outdoor coil.

As shown in FIG. 15, operation begins by having an air-conditioning unit (i.e., the AC) determine its mode of operation (1505) and use this mode to determine how it should operate. (1510). This mode will be either a cooling mode in which the AC operates to cool indoor air in a room or building, or a heating mode in which the AC operates to warm indoor air in the room or building. Although not shown in FIG. 15, having the AC turned off could be considered a third operating mode. However, since this would simply involve shutting everything in the AC off, it is not described.

If the operating mode is a cooling mode, the AC will turn the drain pump off and will close the drain valve, plugging the drain hole (1515).

Although operation 1515 states that the drain valve will be set as closed based on the mode of the AC (i.e., the mode being a cooling mode), in some embodiments the drain valve will be an independent temperature-controlled valve what will close the drain valve when a valve temperature $T_V$ rises above a valve threshold temperature $T_{VTH}$ and keep the drain valve open when the valve temperature $T_V$ is not above the valve threshold temperature $T_{VTH}$.

Under these conditions, water will collect in the lowest trough, the middle trough, and the highest trough in the drain pan (1520). The water will collect in these portions of the drain pan because when the AC is operating in a cooling mode, meaning that the indoor coil of the AC will operate as an evaporator coil and will be cooler than the indoor air. As result, water from the indoor air will condense onto the indoor coil and drip into the drain pan.

The water will reach the highest trough in the drain pan during a cooling mode because the drain pump will be off and the drain valve will keep the drain hole closed. With the drain pump off, no water will be pumped out of the lowest trough; and with the drain hole closed, no water will flow out of the drain hole in the middle trough.

When the water collected in the drain pan reaches the highest trough, the slinger ring connected to the fan blade will collect water from the highest trough and throw the collected water onto the outdoor coil (1525). Since during a cooling mode the outdoor coil operates as a condenser coil and will be warmer than the outdoor air, the water will fully or mostly evaporate and will not significantly drip back into the drain pan. Typically the fan in the AC will be arranged such that the slinger ring on the fan blade will draw water from the drain pan and throw it on the outdoor ring faster than water will condense on the indoor coil and drip into the drain pan.

After the slinger ring throws water onto the outdoor coil (1525), the AC determines whether the operational mode of the AC has changed (1530). If the mode has not changed (i.e., it remains in a cooling mode) then the AC continues collecting water in the highest trough in the drain pan (1520), having the slinger ring throw water onto the outdoor coil (1525), and determining whether the operational mode of the AC has changed (1530).

If the mode has changed, then the AC proceeds to determine what the current mode of the AC is (1505, 1510) and proceeds accordingly.

Although FIG. 15 shows operations 1520, 1525, and 1530 as being performed sequentially, these operations may be performed continually and at the same time. For example, the water draining from the indoor coil into the drain pan, the slinger ring on the fan blade throwing water from the drain pan onto the outdoor coil, and a controller determining whether the operational mode of the AC has changed can all be performed simultaneously.

If the AC determines that the AC mode is a heating mode (1510), then the AC will proceed to determine the outdoor temperature $T_O$ (1535). This can be done through a temperature sensor associated with the AC, a temperature sensor remote from the AC that sends a temperature value back to the AC, or any suitable way of determining an outdoor temperature.

The AC will then compare the outdoor temperature $T_O$ with an outdoor threshold temperature $T_{OTH}$ to determine whether the outdoor temperature $T_O$ is greater than the outdoor threshold temperature $T_{OTH}$ (1540). In many embodiments the outdoor threshold temperature $T_{OTH}$ will be at or near the freezing temperature of water, though this is by way of example only.

If the outdoor temperature $T_O$ is greater than the outdoor threshold temperature $T_{OTH}$, the AC will turn the drain pump off and will open the drain valve allowing the drain hole to pass water through it (1545). In this situation it is determined that it will be safe for water to drain out of the drain hole in the drain pan. For example, if the outdoor threshold temperature $T_{OTH}$ is at or near the freezing temperature of water, it will be determined that there is no danger of draining water freezing in the AC or just outside of the AC (e.g., in the AC, on the ground below an AC drain outlet, or on the side of the building containing the AC drain outlet).

Although operation 1545 states that the drain valve will be set as open based on the comparison of the outdoor temperature $T_O$ to the outdoor threshold temperature $T_{OTH}$, in some embodiments the drain valve will be an independent temperature-controlled valve what will close the drain valve when a valve temperature $T_V$ rises above a valve threshold temperature $T_{VTH}$ and keep the drain valve open when the valve temperature $T_V$ is not above the valve threshold temperature $T_{VTH}$. The valve threshold temperature $T_{VTH}$ could be the same or different from the threshold temperature $T_{OTH}$.

Water will then collect in the drain pan, eventually rising to the middle trough that contains the drain hole (1550). This will occur as moisture in the indoor air condenses on the outdoor coil and drips into the drain pan.

Once water in the drain pan rises to the level of the middle trough, it will then drain from the middle trough of the drain pan through the drain hole, which has been set to be open by the drain valve (1555). The size of the drain hole will typically be set such that it will allow water to drain faster than it can accumulate from condensation dripping off the indoor coil.

After water drains out of the drain hole in the middle trough (1555), the AC again determines whether the operational mode of the AC (1505, 1510), and if the mode remains in the heating mode it again determines the outdoor temperature $T_O$ (1535) and proceeds accordingly.

If the outdoor temperature $T_O$ is not greater than the outdoor threshold temperature $T_{OTH}$, the AC will turn the drain pump on (1560). In this situation it is determined that it will not be safe for water to drain out of the drain hole in the drain pan. For example, if the outdoor threshold temperature $T_{OTH}$ is at or near the freezing temperature of water, it will be determined that there is a danger of draining water freezing in the AC or just outside of the AC (e.g., on the ground below an AC drain outlet or on the side of the building containing the AC drain outlet). In this case, the drain pump will be activated to keep the water from rising to the level of the middle trough.

Water will then collect in the drain pan, settling first in the lowest trough in which the input for the drain pump is located (1565). This will occur as moisture in the indoor air condenses on the outdoor coil and drips into the drain pan.

Once water settles in the bottom trough to a point at which the pump can start pumping it, the water will then be pumped from the bottom trough of the drain pan through a drain pipe onto the indoor coil (1570). If necessary, a heater will operate to prevent the water from freezing in the AC. The water will then evaporate from the indoor coil, cooling the indoor coil and humidifying the indoor air. The pump will typically be configured such that it will pump water faster than water can accumulate in the drain pan from condensation dripping off the indoor coil.

After water is pumped out of the bottom trough onto the indoor coil (1570), the AC again determines whether the operational mode of the AC (1505, 1510), and if the mode remains in the heating mode it again determines the outdoor temperature $T_O$ (1535) and proceeds accordingly.

The status of the drain valve is not relevant during the operations 1550 and 1555 since the drain pump will operate to pump water out of the bottom trough before it can rise to the middle trough that contains the drain hole. As a result, the drain valve can be set either to open or closed when the drain pump is turned on (1560). In one embodiment the drain valve will be an independent temperature-controlled valve what will close the drain valve when a valve temperature $T_V$ rises above a valve threshold temperature $T_{VTH}$ and keep the drain valve open when the valve temperature $T_V$ is not above the valve threshold temperature $T_{VTH}$. In such an embodiment, the drain valve will likely be set to be open during operations 1565 and 1570. However, alternate embodiments are possible in which the drain valve is set to be closed during operations 1565 and 1570.

Thus, when the AC is on it engages in one of three operations to remove water from the drain pan: a water slinging operation, a water draining operation, and a water pumping operation, depending upon whether the AC is in a heating or cooling mode, and based on the outdoor temperature if the AC is in a heating mode. The three-tiered drain pan allows the AC to selectively remove water from the drain pan using a desirable water-removal operation.

Operation of the Cleaning Cycle of the Air-Conditioner

Figure 16:
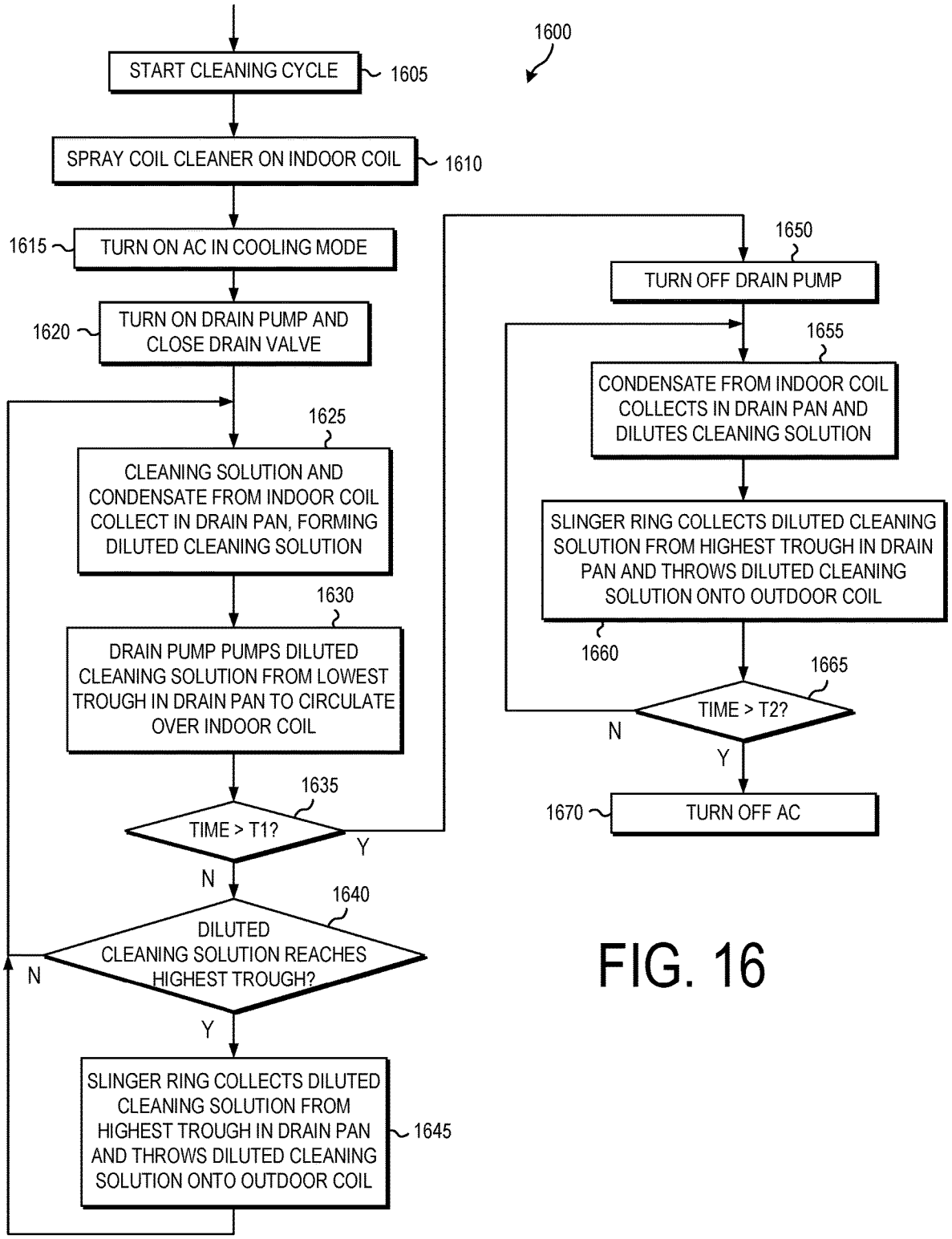
FIG. 16 is a flow chart of an air-conditioner having a multiple-tiered drain pan during a cleaning operation according to disclosed embodiments.

FIG. 16 is a flow chart of an air-conditioner (AC) cleaning operation 1600 according to disclosed embodiments. This operation is typically performed at a temperature when the AC will operate in a cooling mode (e.g. 15-20° C. or higher).

As shown in FIG. 16, operation begins when a cleaning cycle starts (1605). At this stage of operation, the AC is off and an indoor coil in the AC is dry. Although not noted in FIG. 16, the indoor coil may be vacuumed at the beginning of the cleaning cycle in order to remove particles from the surface of the indoor coil.

A user than sprays a coil cleaning solution on the surface of the indoor coil to evenly coat the indoor coil with the coil cleaner (1610). The coil cleaning solution is typically left in place on the indoor coil for a time (e.g., 3-10 minutes) once the indoor coil is fully coated with coil cleaning solution.

Once the indoor coil is fully coated with coil cleaning solution and has been allowed to sit for the desired time (if any), the AC is turned on in a cooling mode (1615). This will have the effect of operating the indoor coil as an evaporator coil, and operating an outdoor coil as a condenser coil.

A drain pump configured to pump liquid from a lowest trough in a drain pan is then turned on, and a drain valve connected to a drain hole in a middle trough in the drain pan is set to be closed (1620), preventing liquid from flowing out of the drain hole.

With the indoor coil operating as an evaporator coil, water in the indoor air will condense onto the indoor coil. The condensate from the indoor coil will drip from the indoor coil into the drain pan. As it does so, the condensate from the indoor coil will begin to clean some of the cleaning solution off of the indoor coil. This mixture of cleaning solution and condensate from the indoor coil will then collect in the drain pan, forming a diluted cleaning solution (i.e., a water-cleaning solution mixture) (1625). This diluted cleaning solution will settle first in the lowest trough of the drain pan.

Once the liquid in the drain pan rises to the level in the lowest trough where the intake of the drain pump is located, the drain pump will begin to pump the diluted cleaning solution from the lowest trough in the drain pan onto the indoor coil (1630). The diluted cleaning solution, along with additional condensed water from the indoor air will than operate to further wash some of the cleaning solution off of the indoor coil.

The AC then determines whether the cleaning operation has been progressing for more than a time T1 (1635). In one embodiment, time T1 can be in the range of 30-60 minutes, though this is by way of example only. Other settings for time T1 can be used in alternate embodiments. Time T1 represents the point at which most of the cleaning solution should be wiped off the indoor coil and the drain pump will be turned off.

If the cleaning operation has not been progressing for more than time T1, the AC will determine whether the liquid in the drain pan has reached the highest trough in the drain pan (1640). The liquid in the drain pan will continue to rise despite the fact that the drain pump is operating because the drain pump acts to pump the liquid in the drain pan onto the indoor coil, which is operating as an evaporator coil. Thus, the indoor coil is cool relative to the liquid in the drain pan and so none of the liquid pumped from the drain pan should evaporate off of the indoor coil. Instead, this liquid, along with the freshly condensed water from the indoor air, will drip into the drain pan, steadily raising the level of liquid in the drain pan, and wiping cleaning solution off the indoor coil.

Typically, the AC will make this determination based on whether a slinger ring connected to a fan blade in the AC makes contact with the liquid in the drain pan. This will only occur when the liquid in the drain pan reaches the highest trough.

If the liquid in the drain pan has not reached the highest trough, the indoor coil will continue to condense water from the indoor air and cleaning solution and condensate from the indoor coil will continue to collect in the drain pan further diluting the cleaning solution (1625). The drain pump will continue to pump the diluted cleaning solution over the indoor coil (1630).

However, if the liquid in the drain pan reaches the highest trough, the slinger ring on the fan blade will begin to collect diluted cleaning solution from the highest trough in the drain pan and throw that diluted cleaning solution onto the outdoor coil (1645). Since the outdoor coil is operating as a condenser coil, it will generally be warmer than the diluted cleaning solution and so the diluted cleaning solution will fully or mostly evaporate from the outdoor coil. Operation will than continue with more condensate forming on the indoor coil, mixing with the cleaning solution, and dripping into the drain pan (1625), and the pump continuing to pump the diluted cleaning solution from the drain pan onto the indoor coil (1630).

Although operations 1625-1645 are shown as being performed sequentially, this is for ease of explanation. In fact, these operations can be performed in parallel. In particular, water will condense on the indoor coil, mix with the cleaning solution, and drip into the drain pan. Simultaneously, the drain pump will pump diluted cleaning solution onto the indoor coil, to mix with the water condensing on the indoor coil and the cleaning solution remaining on the indoor coil likewise, once the liquid in the drain pan reaches the highest trough, the slinger ring will simultaneously begin taking cleaning solution from the highest trough in the drain pan and throwing it onto the outdoor coil. As this is happening, a controller in the AC will continually monitor for whether the time of operation of the cleaning mode is greater than the time T1.

Once the AC determines that the cleaning mode has been operating for more than a time T1, it will turn off the drain pump (1650). Once this happens, liquid from the drain pan will no longer be pumped from the drain pan onto the indoor coil.

However, since the indoor coil is still operating as an evaporator coil, water will continue to condense from the indoor air on the indoor coil. Condensate from the indoor coil will then drip from the indoor coil, collecting in the drain pan and further diluting the cleaning solution (1655). This will have the continued effect of washing off any remaining cleaning solution from the indoor coil. In addition, once all or most of the cleaning solution is washed off of the indoor coil (which may have been by time T1, or may have been some time after time T1), the continual addition of water condensed from the indoor coil will serve to further dilute the water-cleaning solution mixture contained in the drain pan. In other words the ratio of water to cleaning solution will continue to rise as water continues to condense on the indoor coil and drip into the drain pan.

At this point, the water in the drain pan should be at the level of the highest trough. Thus, the slinger ring connected to the fan blade in the AC will collect diluted cleaning solution from the highest trough in the drain pan and throw the diluted cleaning solution onto the outdoor coil (1660). As noted above, since the outdoor coil is operating as a condenser coil and should be warmer than the liquid in the drain pan, the liquid in the drain pan should evaporate from the outdoor coil rather than dripping back into the drain pan. Typically the slinger ring and fan in the AC are configured such that they can remove water from the drain pan faster than water can condense from the indoor coil. Thus, there should be no danger of water overflowing the drain pan.

By continuing operation of the AC in a cooling mode past time T1, the AC provides additional time for water to condense on the indoor coil and drip into the drain pan, further diluting the water-cleaning solution mixture in the drain pan. Furthermore, since the slinger ring is continually removing water-cleaning solution mixture from the drain pan, and the indoor coil is continually adding water to the drain pan, if these operations are allowed to progress, the ratio of water to cleaning solution in the water-cleaning solution mixture will continue to rise, making the liquid in the drain pan a more and more dilute cleaning solution.

The AC will then determine whether the cleaning cycle has been operating for more than a time T2 (1665). Time T2 will be greater than time T1 and will be selected to be a time considered long enough to allow the liquid in the drain pan to become mostly water. In one embodiment, time T2 can be 45-90 minutes. However, this is by way of example only. Alternate settings for time T2 can be used in other embodiments.

If the time of operation of the cleaning cycle is not greater than time T2, the AC will continue to operate in a cooling mode, condensate will continue to form on the indoor coil and drip into the drain pan (1655), and the slinger ring will continue to collect diluted cleaning solution from the drain pan and throw it onto the outdoor coil (1660).

If, however, the time of operation of the cleaning cycle is greater than time T2, the AC will turn off, ending the cooling mode (1670). At this point, liquid will remain in the drain pan. However, this liquid should be mostly water. Furthermore, there should be little to no cleaning solution remaining on the indoor coil. The liquid in the drain pan can then be removed, as noted above, during the next normal operation of the AC. In the alternative, a user can arrange to have the liquid in the drain pan removed by some other means prior to the operation of the AC.

Although many of the above operations are listed as being performed in separate steps, this is for ease of disclosure only. The use of a flow chart to describe the cleaning cycle 1600 does not imply that any of these operations need to be performed manually. For example, water will condense and drip into the drain pan washing cleaning solution off the indoor coil, liquid will gather in the drain pan, and the slinger ring will grab liquid from the drain pan and throw it on the outdoor coil automatically as the system operates. In addition, operations that involve turning the AC on or off or modifying the status of the drain pump or the drain valve will be performed automatically by the AC system based on determinations made by a controller.

In this way, a cleaning cycle can be efficiently performed such that an indoor coil will be cleaned, cleaning solution will be removed from the indoor coil into the drain pan, and the majority of that cleaning solution can be removed from the drain pan.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed:

1. An air-conditioner, comprising:

an indoor coil configured to exchange heat with indoor air at an indoor location;

an outdoor coil configured to exchange heat with outdoor air outside of the indoor location;

a drain pan located under the indoor coil and the outdoor coil, the drain pan being configured to catch liquid that drips from the indoor coil and the outdoor coil, the drain pan including a slinging trough having a slinging depth below a reference level of the drain pan, a draining trough having a draining depth below the reference level, a pumping trough having a pumping depth below the reference level, and a drain hole formed in a bottom surface of the draining trough at the draining depth;

a drain valve configured to selectively allow liquid in the drain trough to pass through the drain hole;

a drain pump configured to selectively pump liquid out of the pumping trough through a drain hose;

a fan configured to blow air on the outdoor coil, the fan including a fan blade having a slinger ring, the slinger ring being configured to take liquid from the slinging trough and move the liquid from the slinging trough onto the outdoor coil when the fan is operating; and a controller configured to control operation of at least the drain pump and the fan, wherein the reference level is a level of the drain pan on which at least one of the indoor coil and the outdoor coil rests, the pumping depth is greater than the draining depth, the draining depth is greater than the slinging depth, and the slinging trough, the draining trough, and the pumping trough are all connected such that water draining from the indoor coil and the outdoor coil will initially settle into the pumping trough, will settle into the draining trough only when the pumping trough is filled, and will settle into the skimming trough only when the pumping trough and the draining trough are filled.

2. The air-conditioner of claim 1, wherein the drain pump is further configured to deposit the pumped liquid on the indoor coil.

3. The air-conditioner of claim 1, wherein the drain pan further comprises an indoor discharge pathway having an indoor discharge depth, the indoor discharge pathway being located at least partially under the indoor coil and being connected to at least one of the slinging tough, the draining trough, and the pumping trough such that the liquid that drops from the indoor coil will drop into the indoor discharge pathway and will pass from the indoor discharge pathway to at least one of the slinging tough, the draining trough, and the pumping trough, and an outdoor discharge pathway having an outdoor discharge depth, the outdoor discharge pathway being located at least partially under the outdoor coil and being connected to at least one of the slinging tough, the draining trough, and the pumping trough such that liquid that drops from the outdoor coil will drop into the outdoor discharge pathway and will pass from the outdoor discharge pathway to at least one of the slinging trough, the draining trough, and the pumping trough, wherein the draining depth is greater than both the indoor discharge depth and the outdoor discharge depth.

4. The air-conditioner of claim 1, wherein the drain valve further comprises a drain plug capable of selectively moving into either a closed position in which the drain plug obstruct the drain hole and an open position in which the drain plug does not obstruct the drain hole, wherein the drain plug is configured to move between the open and closed positions based on a valve temperature of the drain valve.

5. The air-conditioner of claim 1, wherein the drain pump is a centrifugal pump.

6. The air-conditioner of claim 1, further comprising:

a heater attached to the drain pipe, the heater being configured to selectively heat liquid passing through the drain pipe.

7. The air-conditioner of claim 1, further comprising:

a heater attached to the drain pump, the heater being configured to selectively heat liquid passing through the drain pump.

8. The air-conditioner of claim 1, further comprising:

a heater attached to the drain pan, the heater being configured to selectively heat liquid settled in the drain pan.

9. The air-conditioner of claim 1, wherein a first difference between the pumping depth and the draining depth is between ⅛ inch and 1 inch, and a second difference between the draining depth and the slinging depth is between ⅛ inch and 1 inch.

10. The air-conditioner of claim 1, further comprising:

a temperature sensor configured to detect at least one of an internal temperature inside the air-conditioner or an outdoor temperature outside the air conditioner.

11. A method of operating an air-conditioner having a controller, an indoor coil, an outdoor coil, a temperature sensor, a drain pan, and a fan, the method comprising: determining that the air-conditioner is operating in a heating mode; detecting one of an internal temperature inside the air-conditioner and an outdoor temperature outside the air-conditioner as a detected temperature; determining that the detected temperature is below a threshold temperature; and pumping liquid settled in the drain pan out of the drain pan after determining that the detected temperature is below the threshold temperature; wherein the liquid is pumped from a pumping depth in the drain pan below a reference level, the pumping depth is lower than a slinging depth in the drain pan below the reference level, the slinging depth is a depth at which fan blades of the fan will contact liquid gathered in the drain pan, and the reference level is a level of the drain pan on which at least one of the indoor coil and the outdoor coil rests.

12. The method of claim 11, wherein the threshold temperature is between 32° F. and 40° F.

13. The method of claim 11, wherein the operation of pumping the liquid out of the drain pan further includes depositing the pumped liquid on the indoor coil.

14. The method of claim 11, wherein the pumping depth is lower than a draining depth in the drain pan below the reference level, and the draining depth is a depth at which a drain hole is provided in the drain pan to allow liquid to drain from the drain pan.

15. The method of claim 11, wherein the draining depth is below the slinging depth, and a first difference between the pumping depth and the draining depth is between ⅛ inch and 1 inch, and a second difference between the draining depth and the slinging depth is between ⅛ inch and 1 inch.

16. The method of claim 11, further comprising:

heating the liquid in one of the drain pan, a drain pump configured to pump the liquid from the drain pan, and a drain pipe connected to the drain pump.

* * * * *